US007828411B2

(12) United States Patent
Inoue et al.

(10) Patent No.: US 7,828,411 B2
(45) Date of Patent: Nov. 9, 2010

(54) LIQUID EJECTION METHOD, LIQUID EJECTION APPARATUS, DOUBLE-SIDE PRINTING METHOD AND IMAGE RECORDING APPARATUS FOR DOUBLE-SIDE PRINTING

(75) Inventors: Hiroshi Inoue, Kanagawa-ken (JP); Toshiyuki Makuta, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 927 days.

(21) Appl. No.: 11/710,526

(22) Filed: Feb. 26, 2007

(65) Prior Publication Data

US 2007/0200888 A1 Aug. 30, 2007

(30) Foreign Application Priority Data

Feb. 27, 2006 (JP) ..... 2006-051203
Mar. 15, 2006 (JP) ..... 2006-071550

(51) Int. Cl.
*B41J 2/165* (2006.01)

(52) U.S. Cl. ..... 347/34; 347/16; 347/104

(58) Field of Classification Search ..... None
See application file for complete search history.

(56) References Cited

U.S. PATENT DOCUMENTS 6,297,840 B1 * 10/2001 Inana ..... 347/175
2003/0011670 A1 1/2003 Shirakawa
2003/0143007 A1 7/2003 Vives et al.
2004/0156664 A1 8/2004 Vives et al.
2004/0189772 A1 * 9/2004 Arai ..... 347/102
2005/0128236 A1 * 6/2005 Fukasaka ..... 347/16

FOREIGN PATENT DOCUMENTS

JP 2003-11334 A 1/2003
JP 2003-266802 A 9/2003
JP 2004-330446 A 11/2004
JP 2004-330637 A 11/2004
JP 2005-67051 A 3/2005
JP 2005-88207 A 4/2005

* cited by examiner

*Primary Examiner*—Manish S Shah
*Assistant Examiner*—Alexander C Witkowski
(74) *Attorney, Agent, or Firm*—Birch, Stewart, Kolasch & Birch, LLP

(57) ABSTRACT

A print unit includes, a first ejection head which ejects a first liquid, a second ejection head which ejects a second liquid and disposed on an upstream side of the first ejection head in terms of a first direction; a conveyance device which conveys a recording medium relatively with respect to the print unit; and a switch-back unit which reverses a conveyance direction of the recording medium, from the first direction, to a second direction opposite to the first direction. Only the first ejection head ejects the first liquid toward the recording medium when the recording medium is conveyed in the first direction; the switch-back unit reverses the direction from the first direction to the second direction; and only the second ejection head ejects the second liquid toward the recording medium when the recording medium is conveyed in the second direction.

16 Claims, 28 Drawing Sheets

LIQUID EJECTION METHOD, LIQUID EJECTION APPARATUS, DOUBLE-SIDE PRINTING METHOD AND IMAGE RECORDING APPARATUS FOR DOUBLE-SIDE PRINTING

BACKGROUND OF THE INVENTION

1. Field of the Invention

The present invention relates to a liquid ejection method, a liquid ejection apparatus, a double-side printing method, and an image recording apparatus for double-side printing. In particular, the present invention relates to technology for preventing floating of mist and thereby preventing contamination caused by two liquids being mixed, in an inkjet apparatus which uses the two-liquid type of ink. Moreover, the present invention also relates to technology for carrying out double-side printing while it prevents contamination on a head due to floating mist occurring during ejection of liquid in an inkjet apparatus which uses a two-liquid type of ink.

2. Description of the Related Art

In the related art, as an image forming apparatus, an inkjet printer (inkjet recording apparatus) is known, which includes an inkjet head (liquid ejection head) having an arrangement of a plurality of nozzles (liquid ejection ports) and which records images on recording medium by ejecting ink (liquid) from the nozzles toward the recording medium while it causes the inkjet head and the recording medium to move relatively to each other.

An inkjet head of an inkjet printer includes pressure generating units. For example, each pressure generating unit includes: a pressure chamber to which ink is supplied from an ink tank via an ink supply channel; a piezoelectric element which is driven by an electrical signal in accordance with image data; a diaphragm which constitutes a portion of the pressure chamber and deforms in accordance with the driving of the piezoelectric element; and a nozzle which is connected to the pressure chamber. The volume of the pressure chamber is reduced in accordance with the deformation of the piezoelectric element, and the ink inside the pressure chamber is thereby ejected from the nozzle in the form of a droplet. An image is formed on a recording medium by combining dots formed by ink droplets ejected from the nozzles of the pressure generating units.

In an inkjet printer of this kind, when ink is ejected from each nozzle of the inkjet head, not only intended ink droplets for forming the image but also very small ink droplets are ejected from the nozzles. Moreover, a portion of an ink droplet rebounds when the droplet is deposited on the recording medium, and it floats in the form of a very small ink droplet. Ink mist thus occurs in the space between the inkjet head and the recording medium.

In cases where an inkjet printer comprising inkjet heads which respectively eject colored inks and forming color images, the ink mist discharged from one inkjet head deposits onto the nozzle surface of another inkjet head, and contamination (hereinafter, this kind of contamination is simply referred to as "contamination between heads") thus occurs. Moreover, there is a possibility that the correct operation of the apparatus is obstructed because of the deposition of the ink mist onto the interior of the apparatus.

Inkjet-type image forming apparatuses are known in which radiation-curable ink, such as an ultraviolet-curable ink (so-called UV ink), is used and droplets of the radiation-curable ink deposited on a recording medium are exposed to radiation in order to cure the ink droplets rapidly, whereby image quality is improved and the recording speed is increased. For example, in a two-liquid type of inkjet head, a treatment liquid containing an ultraviolet curing initiator and an ink containing the base curing material (polymerizable compound) are ejected from different heads. In this case, if contamination on the nozzle surfaces occurs between the head for ejecting the treatment liquid and the head for ejecting the ink (the nozzle surface of the head for the treatment liquid or the nozzle surface of the head for the ink is contaminated by a mist generated from the other head), then the ink solidifies on the nozzle surface and the nozzles become blocked, and ejection defects may thus arise.

The main factor for the occurrence of contamination of this kind is the fact that mist generated during the ejection is moved by the airflow due to the conveyance of the recording medium and the mist is deposited onto the nozzle surfaces of heads positioned further downstream. Therefore, in the related art, in order to prevent contamination of this kind, the distance between heads is increased, the airflow is suppressed by reducing the conveyance speed of the recording medium, or maintenance of the heads is carried out frequently.

Furthermore, in the related art, the attempts mentioned below have been made to recover the ink mist actively.

For example, Japanese Patent Application Publication No. 2004-330637 discloses a recording apparatus which records images on a recording medium by ejecting ink droplets from nozzles of a recording head that moves in a direction perpendicular to the conveyance direction of the recording medium. In this recording apparatus, mist recovery devices are arranged on both ends with respect to the movement (scanning) of the recording head. The mist recovery device (upstream mist recovery device) disposed on the upstream side of the recording head in terms of the scanning direction suctions air, whereas the other mist recovery device (downstream mist recovery device) expels air.

Moreover, for example, Japanese Patent Application Publication No. 2004-330446 discloses a recording apparatus including a flow regulator mechanism having a deflection surface. The flow regulator mechanism is arranged on the downstream of the head surface in terms of the relative movement direction in which the head member is relatively moved with respect to the recording medium by a scanning device. The deflection surface is provided with an absorbing member for absorbing liquid mist. The deflection surface smoothly deflects the airflow so as not to affect the speed of the airflow generated over the head surface due to the relative movement of the head member caused by the scanning device.

Furthermore, for example, Japanese Patent Application Publication No. 2003-11334 discloses an inkjet recording apparatus which uses ink containing an ultraviolet curing agent and records onto a recording medium while it performs reciprocating movement of a recording head in a main scanning direction. In this inkjet recording apparatus, when ink is ejected while the recording head is moved, ultraviolet light is radiated onto the ink deposited on the recording medium, from a position in front of the ink ejection unit in terms of the movement direction of the recording head.

Moreover, various inkjet recording apparatuses with an inkjet head for carrying out double-side printing onto a recording medium have been proposed in the related art.

For example, Japanese Patent Application Publication No. 2003-266802 discloses an inkjet recording apparatus in which a first printing unit and a second printing unit are disposed in mutually opposing positions. The first printing unit and the second printing unit respectively print onto a first side face and a second side face of a recording medium, in a simultaneous fashion.

Moreover, for example, Japanese Patent Application Publication No. 2005-88207 discloses an inkjet recording apparatus including a paper inverting device. In this inkjet recording apparatus, after printing on the front surface of a recording paper, the recording paper is once conveyed to the paper inverting device and is inverted. The recording paper is then returned to the conveyance device, and printing is carried out onto the rear surface of the recording paper. Double-side printing is carried out in this way. Moreover, this inkjet recording apparatus uses ink which is subjected to an aggregation reaction, in order to prevent bleeding and print-through, and the like, of the ink deposited on the paper, which may be problematic especially in the case of double-side printing.

Furthermore, for example, Japanese Patent Application Publication No. 2005-67051 discloses an inkjet recording apparatus for double-side printing. In this inkjet recording apparatus, an image is formed on one surface of a recording medium, and a portion of the recording medium is then outputted to a paper output tray. The recording medium is then drawn back into the main body of the inkjet recording apparatus, and the recording medium is conveyed and sent to a double-side conveyance path by a switch-back system. Double-side printing is carried out in this way.

However, in the technology described in Japanese Patent Application Publication No. 2004-330637, in order to prevent contamination between the heads by recovering the mists generated by the heads, it is necessary to dispose a mist recovery device for each of the heads. The spaces for the mist recovery devices hence need to be provided, and therefore, the recording apparatus becomes large in size. Moreover, when the distance between the heads is increased, displacement of the dot positions is liable to occur; therefore, it becomes difficult to achieve high image quality. Furthermore, in order to achieve high image quality, highly precise conveyance is necessary, and accordingly the costs can be increased.

Similarly, in the technology described in Japanese Patent Application Publication No. 2004-330446, if it is sought to prevent contamination between the heads by recovering the mists of the heads, then it is necessary to dispose a flow regulating mechanism between the heads, and consequently apparatus size can be increased, image quality may be reduced, and costs can be increased.

In the technology described in Japanese Patent Application Publication No. 2003-11334, it is necessary to dispose ultraviolet light radiation units on either side of the head, and therefore space for this installation is required. Moreover, in order to prevent the ink from curing on the ejection surface due to the effects of the ultraviolet light, it is necessary to increase the distance between the ultraviolet irradiation unit and the heads. Therefore, apparatus size can be increased.

Thus, in each of the related art cases described above, there are obstacles, such as increased size of the apparatus, degradation of image quality due to increase in the distance between the heads, and increased costs as a result of the need for high-precision conveyance. The related art technologies described above relate to a shuttle type head in which a recording head is moved in a direction perpendicular to the conveyance direction of the recording medium. However, in a line-type of semi-fixed head, since depositing position errors become more readily recognizable in comparison with a shuttle type of head, then the effects of contamination are very marked. If it is sought to avoid this kind of situation by means of frequent maintenance, then it is necessary to move a wiping blade or a cap to the underside (maintenance position) of the semi-fixed head and to implement maintenance. This maintenance action requires time and labor, and moreover, the productivity declines due to the increase in the frequency of maintenance.

In a case where liquids (reaction-liquids) of a two-liquid reaction type are ejected, it is difficult to remove the liquids that are hardened due to the curing reaction caused by contamination between the two liquids even if the maintenance action is performed, and moreover, ejection failures may arise due to curing in the nozzle units. In the related art method which recovers ink mist as described above, it is difficult to prevent contamination between heads sufficiently.

In the technology described in Japanese Patent Application Publication No. 2003-266802, since heads (print units) are disposed so as to face each other, then liquid droplets and ink mist discharged from one head are liable to be deposited onto the nozzle surface of the other head. Therefore, contamination can occur between the heads, leading to deterioration of the image. In particular, in cases of using reactive ink, contamination on the nozzle surface of the head occurs and the ink becomes cured, leading to blocking of the nozzles.

In the technology described in Japanese Patent Application Publication No. 2005-88207, the ink head unit Y and the ink head unit K, which respectively eject Y ink and K ink reacting with the Y ink, are disposed in mutually adjacent positions as shown in FIG. 14 in Japanese Patent Application Publication No. 2005-88207. Therefore, there is a possibility that Y ink mist deposits onto the nozzle surface of the head K, because of the airflow created by the conveyance of the paper. If the Y ink mist deposits onto the nozzle surface of the head K, then an aggregation reaction occurs between the Y ink and the K ink, thus leading to the occurrence of nozzle blockages, which are the cause of image deterioration. Moreover, as shown in FIG. 1 in Japanese Patent Application Publication No. 2005-88207, since the inverting mechanism projects to the outer side of the head rows, then the installation surface area of the apparatus is increased. In addition, surplus space is also required for a cover, or the like, which is provided in the conveyance path in order to prevent the adherence of dirt, and the like, to the surface of the printed medium.

In the technology described in Japanese Patent Application Publication No. 2005-67051, similarly to the technology described in Japanese Patent Application Publication No. 2005-88207, there is a possibility that the installation surface area of the apparatus increases since a switch-back unit is provided on the outer side of the apparatus. Moreover, the technology described in Japanese Patent Application Publication No. 2005-67051 does not take account of the occurrence of contamination between the heads.

SUMMARY OF THE INVENTION

The present invention has been contrived in view of the foregoing circumstances. It is an object of the present invention to eliminate a problem due to contamination on a nozzle surface by suppressing the floating of mist generated during ejection of liquid droplets from nozzles, and particularly, to provide a liquid ejection method and a liquid ejection apparatus capable of preventing the occurrence of contamination between head groups in an apparatus which ejects a liquid of a two-liquid reaction type, which has not been investigated in the related art. Moreover, it is another object of the present invention to provide a double-side printing method and a recording apparatus for double-side printing which prevent contamination on a head caused by floating mist generated during ejection of liquid and which can implement double-side printing with a compact apparatus composition occupying a reduced installation surface area.

The present invention is directed to a liquid ejection apparatus comprising: a print unit including a first ejection head which ejects a first liquid and a second ejection head which ejects a second liquid, the second ejection head being disposed on an upstream side of the first ejection head in terms of a first conveyance direction; a conveyance device which conveys a recording medium relatively with respect to the print unit; and a switch-back unit which reverses a relative conveyance direction of the recording medium, from the first conveyance direction in which the recording medium is relatively conveyed for a first time, to a second conveyance direction which is opposite to the first conveyance direction and in which the recording medium is relatively conveyed for a second time, wherein: the first ejection head ejects the first liquid toward the recording medium and the second ejection head does not eject the second liquid when the recording medium is relatively conveyed in the first conveyance direction for the first time; the switch-back unit reverses the relative conveyance direction of the recording medium from the first conveyance direction to the second conveyance direction; and the first ejection head does not eject the first liquid and the second ejection head ejects the second liquid toward the recording medium when the recording medium is relatively conveyed in the second conveyance direction for the second time.

In this aspect of the present invention, mist of the first liquid does not move toward the second ejection head during liquid ejection of the first liquid, and mist of the second liquid does not move toward the first ejection head during liquid ejection of the second liquid. Therefore, it is possible to prevent the occurrence of nozzle surface contamination.

Preferably, the liquid ejection apparatus further comprises a radiation irradiating unit which is disposed on a downstream side of the second ejection head in terms of the second conveyance direction and irradiates the recording medium on which the first liquid and the second liquid have been deposited, wherein the first liquid is a treatment liquid containing a radiation curing initiator, and the second liquid is an ink containing a polymerizable compound.

In this aspect of the present invention, it is possible to suppress contamination caused by adherence of mists on heads, thereby preventing problems of nozzle blockages, and the like.

Preferably, the first liquid is a treatment liquid containing an aggregating agent, and the second liquid is an ink containing an aggregation material which aggregates by reacting with the aggregating agent.

In this aspect of the present invention, it is possible to prevent contamination due to the adherence of mists on heads.

Preferably, the liquid ejection apparatus further comprises a squeezing unit which is disposed on an immediately downstream side of the first ejection head in terms of the first conveyance direction and which squeezes the excess first liquid deposited on the recording medium.

In this aspect of the present invention, it is possible to spread out the first liquid uniformly over the recording medium, and therefore image quality can be improved. Moreover, by adopting the squeezing unit for spreading the surplus liquid uniformly, it is possible to reduce performance demand of liquid ejection for the first ejection head, and therefore the production yield can be improved and processing costs can be reduced.

The present invention is also directed to a liquid ejection method for a liquid ejection apparatus which has a print unit including a first ejection head for ejecting a first liquid and a second ejection head for ejecting a second liquid and which conveys a recording medium relatively with respect to the print unit, the liquid ejection method comprising the steps of: performing a first relative conveyance to convey the recording medium relatively with respect to the print unit; reversing a relative conveyance direction of the recording medium with respect to the print unit after the first relative conveyance; and performing a second relative conveyance to convey the recording medium relatively with respect to the print unit again, wherein: in the first relative conveyance, the second ejection head does not eject the second liquid when the recording medium passes below the second ejection head, and the first ejection head ejects the first liquid toward the recording medium when the recording medium passes below the first ejection head; in the second relative conveyance, the first ejection head does not eject the first liquid when the recording medium passes below the first ejection head, and the second ejection head ejects the second liquid toward the recording medium when the recording medium passes below the second ejection head.

In this aspect of the present invention, mist of the first liquid does not move toward the second ejection head during liquid ejection of the first liquid, and mist of the second liquid does not move toward the first ejection head during liquid ejection of the second liquid. Therefore, it is possible to prevent the occurrence of nozzle surface contamination.

Preferably, the liquid ejection method further comprises the step of irradiating the recording medium on which the first liquid and the second liquid have been deposited, wherein the first liquid is a treatment liquid containing a radiation curing initiator, and the second liquid is an ink containing a polymerizable compound.

In this aspect of the present invention, it is possible to suppress contamination caused by adherence of mists on heads, thereby preventing problems of nozzle blockages, and the like.

The present invention is also directed to an image forming apparatus comprising any one of the liquid ejection apparatuses as defined above.

In this aspect of the present invention, the occurrence of contamination on the nozzle surface of each head is suppressed and the image quality of the recorded image can be improved.

The present invention is also directed to an image recording apparatus for double-side printing comprising: a print unit including a first ejection head which ejects a first liquid and a second ejection head which ejects a second liquid, the second ejection head being disposed on an upstream side of the first ejection head in terms of a first conveyance direction; a paper supply unit for supplying a recording medium; a conveyance device for relatively conveying the recording medium supplied from the paper supply unit, with respect to the print unit; a switch-back unit which reverses a relative conveyance direction of the recording medium, from the first conveyance direction in which the recording medium is relatively conveyed for a first time, to a second conveyance direction which is opposite to the first conveyance direction and in which the recording medium is relatively conveyed for a second time; and an inverting unit which inverts the recording medium, wherein: the first ejection head ejects the first liquid toward a front surface of the recording medium and the second ejection head does not eject the second liquid when the recording medium is relatively conveyed in the first conveyance direction for the first time, and the first ejection head does not eject the first liquid and the second ejection head ejects the second liquid toward the front surface of the recording medium when the recording medium is relatively conveyed in the second conveyance direction for the second time after the switch-back unit reverses the relative conveyance direction of the recording medium from the first conveyance direction to the second conveyance direction, in such a manner that printing is performed on the front surface of the recording medium; the inverting unit inverts the recording medium after printing is performed on the front surface of the recording medium; after the inverting unit inverts the recording medium, the first ejection head ejects the first liquid toward a rear surface of the recording medium and the second ejection head does not eject the second liquid when the recording medium is relatively conveyed in the first conveyance direction, and the first ejection head does not eject the first liquid and the second ejection head ejects the second liquid toward the rear surface of the recording medium when the recording medium is relatively conveyed in the second conveyance direction after the switch-back unit reverses the relative conveyance direction of the recording medium from the first conveyance direction to the second conveyance direction, in such a manner that printing is performed on the rear surface of the recording medium.

In this aspect of the present invention, it is possible to carry out double-side printing while preventing contamination on the nozzle surfaces of the heads.

Preferably, the conveyance device includes a paper supply conveyance path through which the recording medium supplied from the paper supply unit is conveyed to the print unit, and a printing conveyance path through which the recording medium is conveyed relatively in the print unit; and the inverting unit includes an inverting path which branches from the paper supply conveyance path at an intermediate point of the paper supply conveyance path and merges with the printing conveyance path at a point between the first ejection head and the second ejection head.

In this aspect of the present invention, the image recording apparatus for double-side printing which carries out double-side printing while preventing contamination on the nozzle surfaces of the heads can be reduced in size, and therefore the installation surface area can be reduced and a compact composition can be achieved. Moreover, since the number of switch-backs is reduced, the number of temporary halts of conveyance of the recording medium due to the switch-backs is reduced. Hence, the recording time is shortened, and increased recording speed can be achieved. Therefore, it is possible to achieve both a more compact size of the apparatus and a faster recording speed, at the same time.

Preferably, the printing conveyance path is constituted by an endless belt.

In this aspect of the present invention, it is possible to convey two sheets of recording media simultaneously in conjunction with each other, by means of an endless belt. Therefore, the conveyance guides can be simplified, the number of conveyance rollers can be reduced, and costs can be lowered.

Preferably, the image recording apparatus for double-side printing further comprises a radiation irradiating unit which is disposed on a downstream side of the second ejection head in terms of the second conveyance direction and irradiates the recording medium on which the first liquid and the second liquid have been deposited, wherein the first liquid is a treatment liquid containing a radiation curing initiator, and the second liquid is an ink containing a polymerizable compound.

In this aspect of the present invention, it is possible to suppress contamination caused by adherence of mists on the heads, thereby preventing problems of nozzle blockages, and the like.

The present invention is also directed to a double side printing method for a liquid ejection apparatus which has a print unit including a first ejection head for ejecting a first liquid and a second ejection head for ejecting a second liquid and which conveys a recording medium relatively with respect to the print unit, the double side printing method comprising the steps of: performing a first relative conveyance to convey the recording medium relatively with respect to the print unit; reversing a relative conveyance direction of the recording medium with respect to the print unit after the first relative conveyance; performing a second relative conveyance to convey the recording medium relatively with respect to the print unit after reversing the relative conveyance direction of the recording medium after the first relative conveyance; inverting the recording medium after the second relative conveyance; performing a third relative conveyance to convey the recording medium relatively with respect to the print unit after inverting the recording medium; reversing the relative conveyance direction of the recording medium with respect to the print unit after the third relative conveyance; and performing a fourth relative conveyance to convey the recording medium relatively with respect to the print unit after reversing the relative conveyance direction of the recording medium after the third relative conveyance, wherein: in the first relative conveyance, the second ejection head does not eject the second liquid when the recording medium passes below the second ejection head, and the first ejection head ejects the first liquid toward the front surface of the recording medium when the recording medium passes below the first ejection head after the recording medium passes below the second ejection head; in the second relative conveyance, the first ejection head does not eject the first liquid when the recording medium passes below the first ejection head, and the second ejection head ejects the second liquid toward the front surface of the recording medium when the recording medium passes below the second ejection head after the recording medium passes below the first ejection head; in the third relative conveyance, the second ejection head does not eject the second liquid when the recording medium passes below the second ejection head, and the first ejection head ejects the first liquid toward the rear surface of the recording medium when the recording medium passes below the first ejection head after the recording medium passes below the second ejection head; and in the fourth relative conveyance, the first ejection head does not eject the first liquid when the recording medium passes below the first ejection head, and the second ejection head ejects the second liquid toward the rear surface of the recording medium when the recording medium passes below the second ejection head after the recording medium passes below the first ejection head.

In this aspect of the present invention, it is possible to carry out double-side printing while preventing contamination on the nozzle surfaces of the heads.

Preferably, the double-side printing method further comprises the steps of: irradiating the front surface of the recording medium on which the first liquid and the second liquid have been deposited; and irradiating the rear surface of the recording medium on which the first liquid and the second liquid have been deposited, wherein the first liquid is a treatment liquid containing a radiation curing initiator, and the second liquid is an ink containing a polymerizable compound.

In this aspect of the present invention, it is possible to suppress contamination caused by adherence of mists on the heads, thereby preventing problems of nozzle blockages, and the like.

It is possible to prevent the occurrence of nozzle surface contamination according to the present invention. Furthermore, it is also possible to carry out double-side printing while preventing contamination on the nozzle surfaces of the heads.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE INVENTION

First, a liquid ejection method, a liquid ejection apparatus, and an image forming apparatus including a liquid ejection device are described in detail below.

Figure 1:
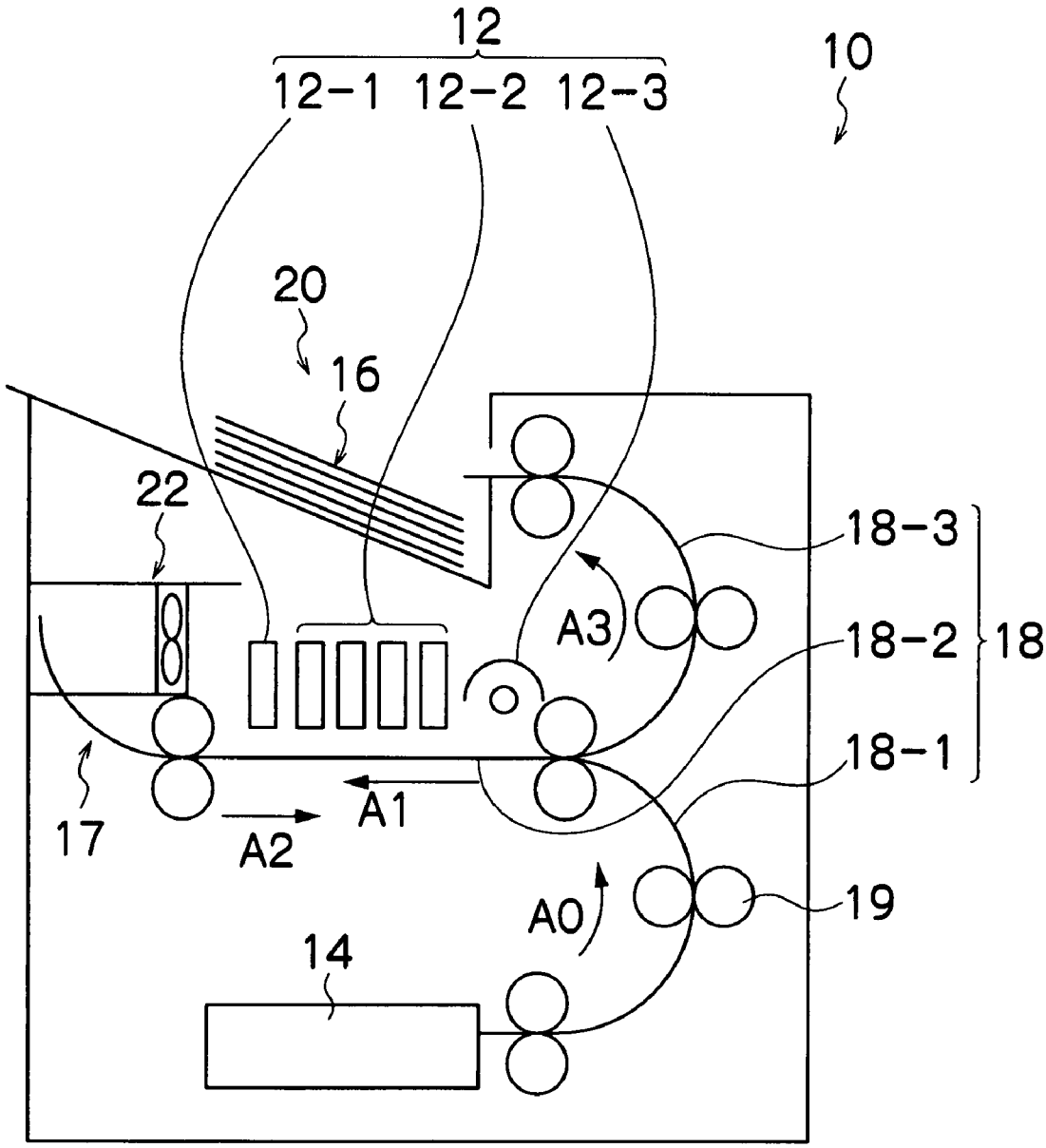
FIG. 1 is a general compositional diagram showing an approximate view of an inkjet recording apparatus forming an image forming apparatus according to a first embodiment of the present invention.

FIG. 1 is a general compositional diagram showing an approximate view of an inkjet recording apparatus serving as an image forming apparatus according to a first embodiment of the present invention.

As shown in FIG. 1, the inkjet recording apparatus 10 according to the first embodiment comprises: a print unit 12 including a first liquid head group (first ejection head) 12-1 which ejects treatment liquid as a first liquid, a second liquid head group (including second ejection heads) 12-2 which ejects inks of colors as second liquids, and a UV (ultraviolet light) irradiation unit (radiation irradiation unit) 12-3; a paper supply unit 14 which supplies recording papers 16 to the print unit 12; a conveyance unit 18 which conveys the recording paper 16; and a paper output unit 20 which outputs printed recording papers 16 to the exterior.

In FIG. 1, the paper supply unit 14 is depicted as a cassette (media stacker) in which cut paper sheets are stacked and loaded, but the paper supply unit 14 is not limited in particular to this. It is also possible to supply the recording paper 16 by means of a magazine which accommodates rolled paper (continuous paper). In cases where rolled paper is used, a cutter should be disposed immediately on the downstream of the magazine, in such a manner that the rolled paper extracted from the magazine is cut to a desired size by the cutter and then conveyed for use. Furthermore, in cases where rolled paper is used, then the paper retains residual curl due to having been loaded in a rolled state in the magazine. In order to remove this curl, for example, it is desirable to provide a decurling unit which applies heat to the recording paper 16 by means of a heating drum, in the direction opposite to the direction in which the paper is rolled in the magazine.

The conveyance unit 18 includes: a first conveyance path 18-1 along which a recording paper 16 is conveyed from the paper supply unit 14 to the print unit 12; a second conveyance path 18-2 along which the recording paper 16 is conveyed directly below the print unit 12; a switch-back unit 17 which reverses the direction of conveyance of the recording paper 16 that has passed below the print unit 12; and a third conveyance path 18-3 along which the printed recording paper 16 is conveyed to the paper output unit 20. Pairs of conveyance rollers 19 for conveying the recording paper 16 are disposed at prescribed positions in each of the conveyance paths 18-1 to 18-3.

As indicated by the arrow A0 in FIG. 1, a recording paper 16 supplied from the paper supply unit 14 is conveyed to the print unit 12 via the first conveyance path 18-1. The recording paper 16 conveyed to the print unit 12 is conveyed through the second conveyance path 18-2, initially (for the first time) from right to left (first conveyance direction) directly below the print unit 12 as indicated by the arrow A1 in FIG. 1, until reaching the switch-back unit 17.

The recording paper 16 conveyed to the switch-back unit 17 is halted provisionally, the conveyance direction is reversed, and it is then conveyed back toward the print unit 12 through the second conveyance path 18-2, this time in the opposite direction (left to right). In other words, when passing the print unit 12 for the second time, the recording paper 16 is conveyed from left to right (second conveyance direction) directly below the print unit 12, as indicated by the arrow A2 in FIG. 1.

In the present embodiment, the recording paper 16 is moved and conveyed relatively with respect to the print unit 12, but during recording, it is also possible to fix the recording paper 16 in a position below the print unit 12 and to move the print unit 12 over the recording paper 16.

The second conveyance path 18-2 is composed so that the recording paper 16 is conveyed in such a manner that the portion thereof opposing the nozzle surfaces (not illustrated) of the heads of the print unit 12 is kept flat. As described above, in the present embodiment, the recording paper 16 is conveyed twice below the print unit 12 by reversing the conveyance direction, and during this, printing is performed onto the recording paper 16 by the print unit 12. The printing method is described in more detail below.

The recording paper (the printed matter) 16 after printing is conveyed to the paper output unit 20 via the third conveyance path 18-3, as indicated by the arrow A3 in FIG. 1, and it is then output from the paper output unit 20. Desirably, a sorter for collecting images according to print orders is provided in the paper output unit 20.

As shown in FIG. 1, in the print unit 12 according to the present embodiment, the UV irradiation unit 12-3, the second liquid head group 12-2, and the first liquid head group 12-1 are arranged in this order, in the second conveyance path 18-2, from the upstream side in terms of the first conveyance direction A1. Moreover, a fan 22 for inhaling (recovering) liquid mist generated by liquid ejection from the first liquid head group 12-1 and the second liquid head group 12-2 is disposed on the downstream side of the print unit 12 in terms of the first conveyance direction A1, in other words, on the downstream side of the first liquid head group 12-1.

Figure 2:
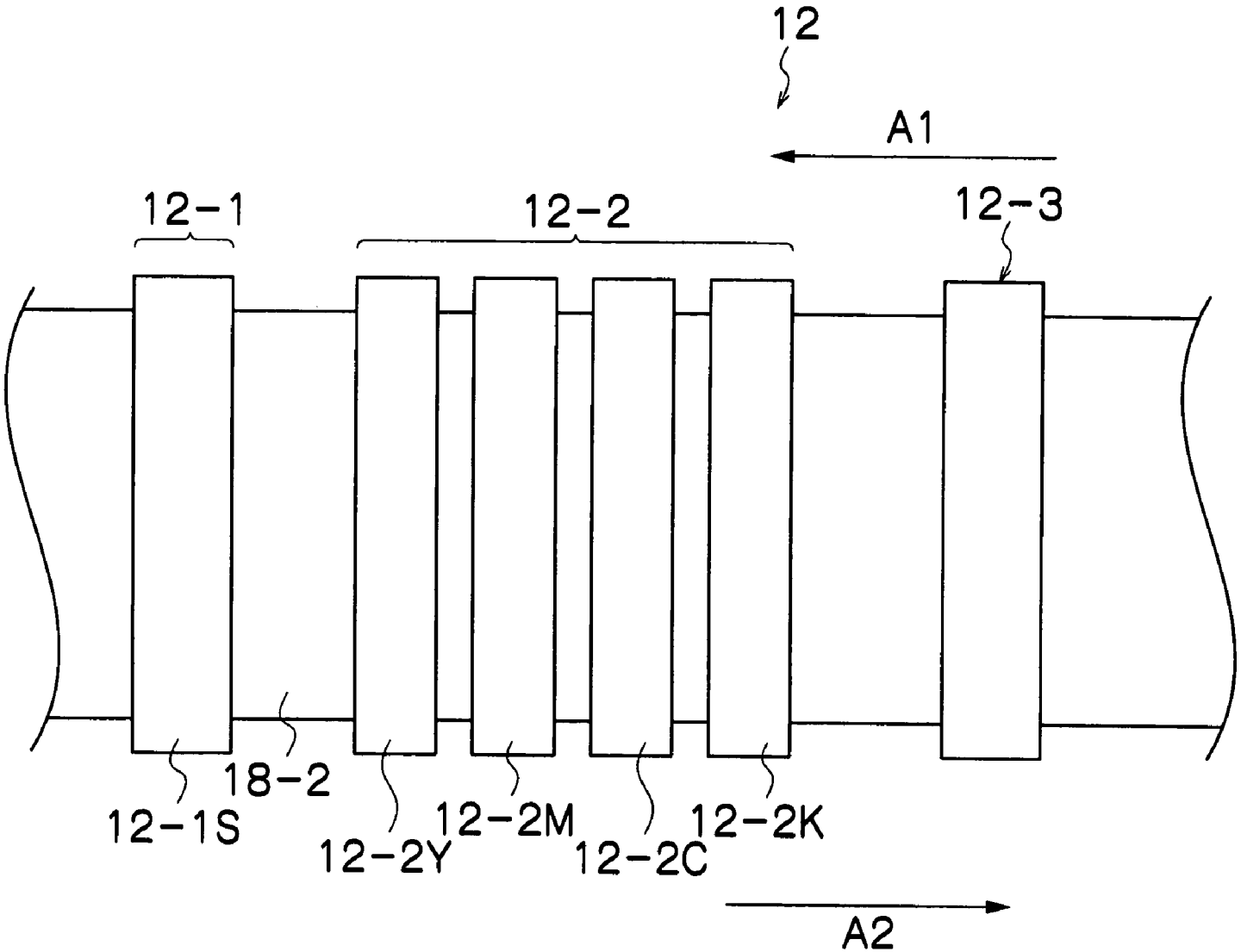
FIG. 2 is a plan diagram showing an enlarged view of the periphery of a print unit of the inkjet recording apparatus according to the first embodiment.

FIG. 2 is a diagram showing an enlarged plan diagram of the peripheral part of a print unit 12.

As described above, the print unit 12 comprises the first liquid head group 12-1 which ejects treatment liquid, the second liquid head group 12-2 which ejects colored inks, and the UV (ultraviolet light) irradiation unit 12-3. The first liquid head group 12-1 includes a treatment liquid head 12-1S which ejects treatment liquid, and the second liquid head group 12-2 includes a print head 12-2Y which ejects yellow (Y) ink, a print head 12-2M which ejects magenta (M) ink, a print head 12-2C which ejects cyan (C) ink, and a print head 12-2K which ejects black (K) ink.

As described above, in the print unit 12, the UV irradiation unit 12-3, the second liquid head group 12-2 and the first liquid head group 12-1 are disposed in this order over the second conveyance path 18-2, from the upstream side in terms of the first conveyance direction indicated by the arrow A1.

Each of the treatment liquid head 12-1S included in the first liquid head group 12-1 and the print heads 12-2Y, 12-2M, 12-2C and 12-2K included in the second liquid head group 12-2 is a line head which has a length corresponding to the maximum paper width of the recording paper 16. All of these heads are full line heads arranged in a direction (main scanning direction) which is perpendicular to the conveyance direction of the recording paper 16 (the first conveyance direction A1; the second conveyance direction A2 in the second conveyance path 18-2; the sub-scanning direction).

Although a configuration with four standard colors, Y M C and K, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

The UV irradiation unit 12-3 includes a UV light source which is formed so as to radiate ultraviolet light over the entire width of the recording paper 16.

The treatment liquid ejected from the treatment liquid head 12-1S used in the inkjet recording apparatus 10 of the present embodiment contains a curing (polymerization) initiator. Furthermore, the colored inks which are ejected from the print heads 12-2Y, 12-2M, 12-2C and 12-2K are ultraviolet-curable inks. Each of the ultraviolet-curable inks contains a polymerizable compound (base curing material) which is cured (polymerized) by application of UV (ultraviolet light) energy, and a coloring material (colorant).

In the present embodiment, each ink contains a coloring material in this way; however, it is not absolutely necessary that the ink contain a coloring material, in order to achieve the benefits of the present invention. Ink may also be a transparent ink.

The term "polymerizable compound" indicates a compound which produces a polymerization reaction and causes curing by means of initial seeds, such as radicals generated from the curing (polymerization) initiator. For example, here, the polymerizable compound includes ultraviolet-curable compounds, such as a monomer, an oligomer, a homopolymer having a low molecular weight, and copolymer having a low molecular weight. Moreover, the treatment liquid may also include a dispersion inhibitor and a high-boiling-point organic solvent.

The curing (polymerization) initiator indicates a compound which generates initial seeds, such as radicals, due to light energy, heat energy, or both light and heat energy, thereby starting and promoting the polymerization of the polymerizable compound. It is possible to use a commonly known thermal polymerization initiator, a compound having bonds of low bond dissociation energy, or a photo polymerization initiator, or the like.

There are no particular restrictions on the coloring material (colorant) used in the present embodiment. Provided that a color hue and color density that matches the object of use of the ink are achieved, it is possible to select a coloring material appropriately from commonly known aqueous dyes, oil-based dyes and pigments.

By adopting a composition which combines treatment liquid and colored inks in this way, image deterioration due to depositing interference can be avoided principally by the function of the dispersion inhibitor contained in the treatment liquid. Moreover, even if light leaking from the UV irradiation unit 12-3 or light reflected by the recording paper 16 reaches the nozzles of the print heads 12-2Y, 12-2M, 12-2C and 12-2K and the treatment liquid head 12-1S, since liquid containing a curing initiator and liquid containing a polymerizable compound are assigned to separate heads rather than being stored in the same head, then no curing reaction (polymerization reaction) occurs, and hence solidification of the treatment liquid and the ink inside the nozzles of the heads is prevented.

If the colored inks contain a curing initiator and the treatment liquid contains a polymerizable compound (UV monomer), apart from the composition of the liquids (treatment liquid and colored inks) described above, then similar beneficial effects described above can be also obtained.

Next, the structure of the head is described below. Since the treatment liquid head 12-1S and the print heads 12-2Y, 12-2M, 12-2C and 12-2K have a common structure, then the head is, hereinafter, denoted simply with reference numeral 50, and the head 50 represents all of the heads (the treatment liquid head and the print heads).

Figure 3A:
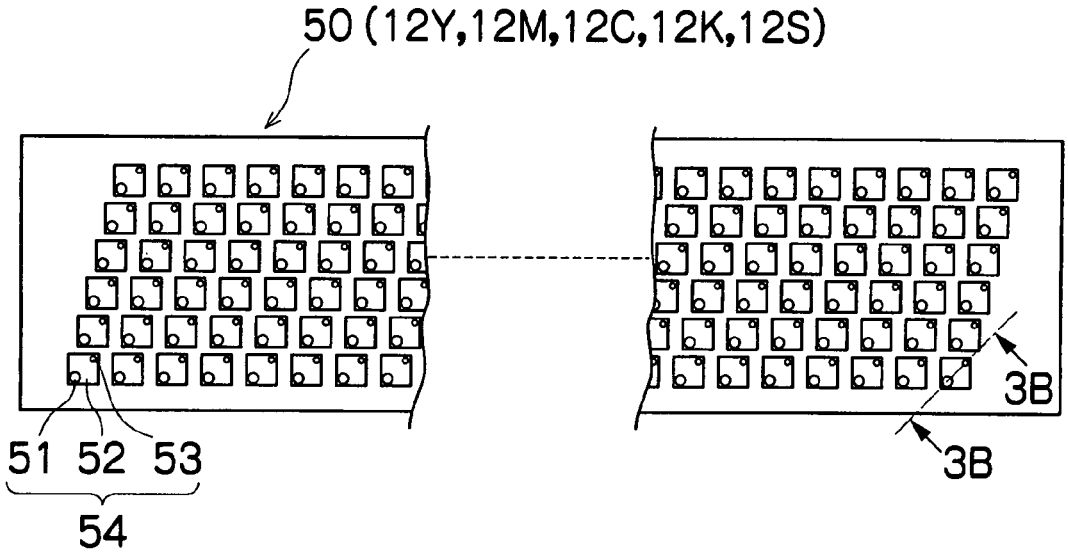
FIG. 3A is a plan view perspective diagram showing the structure of a head.

FIG. 3A is a plan view perspective diagram showing an embodiment of the structure of the head 50.

As shown in FIG. 3A, the head 50 according to the present embodiment has a structure in which pressure chamber units 54, each comprising a nozzle 51 which is an ejection port for liquid (treatment liquid or ink of one of the colors), a pressure chamber 52 corresponding to the nozzle 51, and a supply port 53 which supplies liquid to the pressure chamber 52, and the like, are arranged in a staggered two-dimensional matrix configuration. Accordingly, it is possible to increase the density of the effective nozzle interval (projected nozzle pitch) as projected to an alignment in the lengthwise direction (the direction perpendicular to the conveyance direction of the recording medium) of the head.

The mode of forming one or more nozzle rows having a length corresponding to the entire width of the recording paper 16 in a direction substantially perpendicular to the conveyance direction of the recording paper 16 is not limited to the embodiment shown here. For example, instead of the composition in FIG. 3A, although not shown in the drawings, a line head having nozzle rows of a length corresponding to the entire length of the recording paper 16 can be formed by arranging and combining, in a staggered matrix, short head units having a plurality of nozzles 51 arrayed in a two-dimensional fashion.

As shown in FIG. 3A, the pressure chamber 52 provided corresponding to each of the nozzles 51 of the head 50 is approximately square-shaped in plan view. A nozzle 51 and a supply port 53 are provided respectively at either corner of a diagonal of the pressure chamber 52. The shape of the pressure chamber 52 is not limited to a square shape in this manner and the planar shape of the pressure chamber 52 may be formed into various other shapes, such as a quadrilateral shape (rhomboid, rectangular, or the like), a pentagonal shape, a hexagonal shape, or other polygonal shape, or a circular shape, elliptical shape, or the like.

Figure 3B:
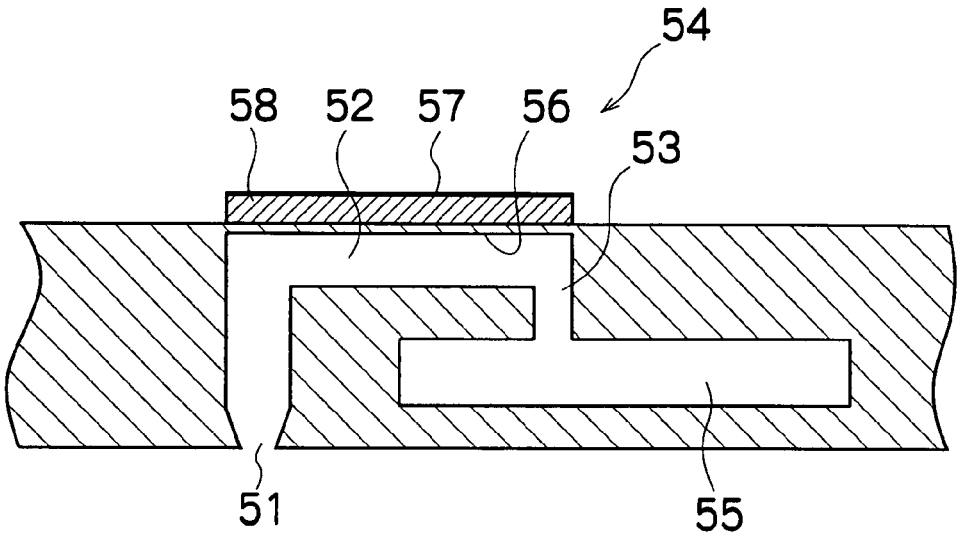
FIG. 3B is a cross-sectional diagram along line 3B-3B in FIG. 3A.

Furthermore, FIG. 3B shows a cross-sectional diagram of the pressure chamber unit 54 along line 3B-3B in FIG. 3A.

As shown in FIG. 3B, each pressure chamber 52 is connected to a common liquid chamber 55 via the supply port 53. The common liquid chamber 55 is connected to a liquid tank which forms a liquid supply tank (not illustrated), and the liquid supplied from the liquid tank is distributed and supplied to the pressure chambers 52 by means of the common liquid chamber 55.

A piezoelectric element (piezoelectric actuator) 58 provided with an individual electrode 57 is bonded to the upper side of a diaphragm 56 which also serves as a common electrode and which forms the ceiling of the pressure chamber 52. When a drive voltage is applied to the individual electrode 57, the piezoelectric element 58 deforms, thereby reducing the volume of the pressure chamber 52. This causes a pressure change which results in liquid in the pressure chamber 52 being ejected from the nozzle 51. After liquid ejection, when the volume of the pressure chamber 52 returns to its original state, new liquid is supplied to the pressure chamber 52 from the common liquid chamber 55 by means of the supply port 53.

Figure 4:
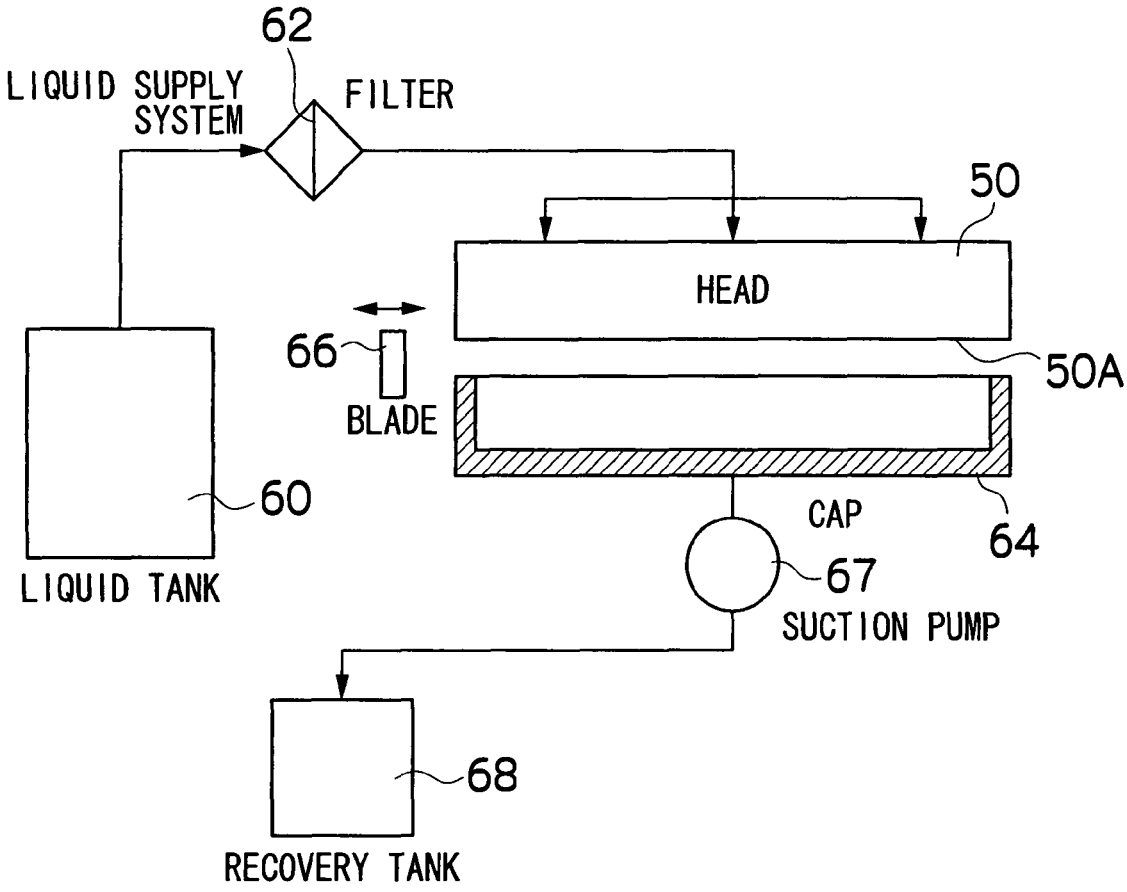
FIG. 4 is a general schematic drawing showing a liquid supply system in the inkjet recording apparatus according to the first embodiment.

FIG. 4 is a general schematic drawing of a liquid supply system which supplies liquid to the head 50 in the inkjet recording apparatus 10 according to the present embodiment.

The liquid tank 60 is a base tank for supplying a liquid (treatment liquid or an ink of one of the colors) to a head (a head which ejects treatment liquid or ink of one of the colors) 50. The liquid tank 60 may adopt a system for replenishing liquid by means of a replenishing port (not illustrated), or a cartridge system in which cartridges are exchanged independently for each tank, whenever the residual amount of liquid has become low. If the type of liquid (for example, the type of ink) is changed in accordance with the intended application, then the cartridge system is suitable. In this case, desirably, the type of liquid (ink) is identified by means of a bar code, or the like, and liquid ejection is controlled in accordance with the type of liquid.

A filter 62 for removing foreign matters and bubbles is disposed at the middle of the line connecting the liquid tank 60 to the head 50 as shown in FIG. 4. The filter mesh size is preferably equivalent to or less than the diameter of the nozzle of the head 50 and commonly about 20 μm.

Although not shown in FIG. 4, it is preferable to provide a sub-tank integrally to the print head 50 or nearby the head 50. The sub-tank has a damper function for preventing variation in the internal pressure of the head 50 and a function for improving refilling of the print head.

The inkjet recording apparatus 10 is also provided with a cap 64 as a device to prevent the nozzles from drying out or to prevent an increase in the liquid viscosity in the vicinity of the nozzles. The inkjet recording apparatus 10 is also provided with a cleaning blade 66 as a device to clean the nozzle face 50A.

A maintenance unit including the cap 64 and the cleaning blade 66 can be relatively moved with respect to the head 50 by means of a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position by the elevator mechanism so as to come into close contact with the head 50, and the nozzle region of the nozzle face 50A is thereby covered with the cap 64.

The cleaning blade 66 is composed of rubber or another elastic member, and can slide on the liquid ejection surface (the nozzle face 50A) of the head 50 by means of a blade movement mechanism (not shown). When liquid droplet or foreign matter has adhered to the nozzle face 50A, the nozzle face 50A is wiped by sliding the cleaning blade 66 on the nozzle face 50A, thereby cleaning the nozzle face 50A.

During printing or standby, when the frequency of use of specific nozzles 51 is reduced, and whereby, for example, ink viscosity increases in the vicinity of the nozzles 51, a preliminary discharge is made to eject the ink degraded due to the increase in viscosity, toward the cap 64.

Also, for example, when bubbles have become intermixed in the ink inside the head 50 (ink inside the pressure chamber 52), the cap 64 is placed on the nozzle face 50A of the head 50, the ink inside the pressure chamber 52 (the ink in which bubbles have become intermixed) is removed by suction with a suction pump 67, and the suction-removed ink is then sent to a collection tank (recovery) 68. The suctioning and removal of degraded ink having an increased viscosity is also implemented when ink (liquid) is initially loaded into the head 50, or when service is started after a long period of having been stopped.

In the head 50 ejecting ink of the colors, when ink has not been ejected for a certain amount of time or longer, the ink solvent in the vicinity of the nozzles 51 evaporates and ink viscosity increases. In such a state, ink can no longer be ejected from the nozzle 51 even if the actuator (laminated piezoelectric element 58) for the ejection driving is operated. Before reaching such a state (in a viscosity range that allows ejection by the operation of the laminated piezoelectric element 58), the laminated piezoelectric element 58 is operated to perform the preliminary discharge to eject the ink having an increased viscosity in the vicinity of the nozzle toward the ink receptor. After the nozzle face 50A is cleaned by a wiper such as the cleaning blade 66 provided for cleaning the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed inside the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink in the nozzle 51 and the pressure chamber 52 and when the ink viscosity inside the nozzle 51 has increased over a certain level, ink can no longer be ejected from the nozzle 51 even if the laminated piezoelectric element 58 is operated. In these cases, the ink in which bubbles have become intermixed or the ink whose viscosity has increased inside the pressure chamber 52 is suctioned with a pump 67 by placing the cap 64 on the nozzle face 50A of the print head 50.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 illustrated in FIG. 4 functions as a suctioning device and it may also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Next, the action of the present embodiment is described below.

As shown in FIG. 1, the recording paper 16 taken out from the media stacker of the paper supply unit 14 is conveyed to the print unit 12 along the first conveyance path 18-1.

Figure 5:
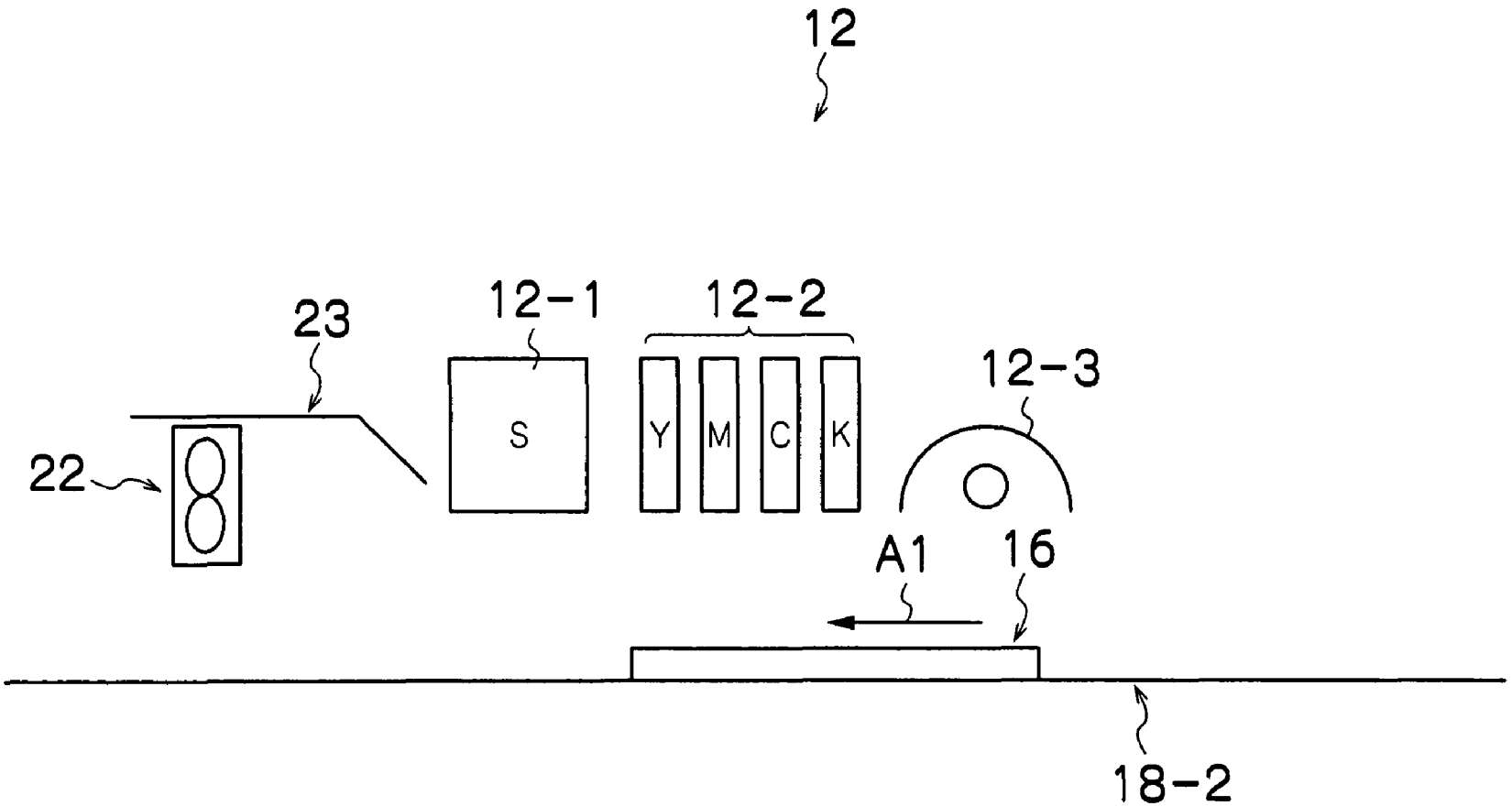
FIG. 5 is an enlarged diagram showing the periphery of the print unit shown in FIG. 1.

FIG. 5 is a diagram showing an enlarged view of the peripheral part of the print unit 12 in FIG. 1.

As shown in FIG. 5, the recording paper 16 conveyed to the print unit 12 is initially (for the first time) conveyed in the first conveyance direction leading from right to left through the second conveyance path 18-2 as indicated by the arrow A1 in FIG. 5. In the print unit 12, the UV irradiation unit 12-3, the second liquid head group 12-2 constituted by the print heads 12-2K, 12-2C, 12-2M and 12-2Y, and the first liquid head group 12-1 constituted by the treatment liquid head 12-1S, are arranged in this order from the upstream side (the right-hand side in FIG. 5) in terms of the first conveyance direction A1. Moreover, the fan 22 for recovering liquid mist, and an air duct 23 for directing the airflow toward the fan 22, are disposed on the downstream side of the first head group 12-1.

When the recording paper 16 initially passes below the print unit 12 following the first conveyance direction (from the right-hand side to the left-hand side in FIG. 5), inks are not ejected from the second liquid head group 12-2.

Figure 6:
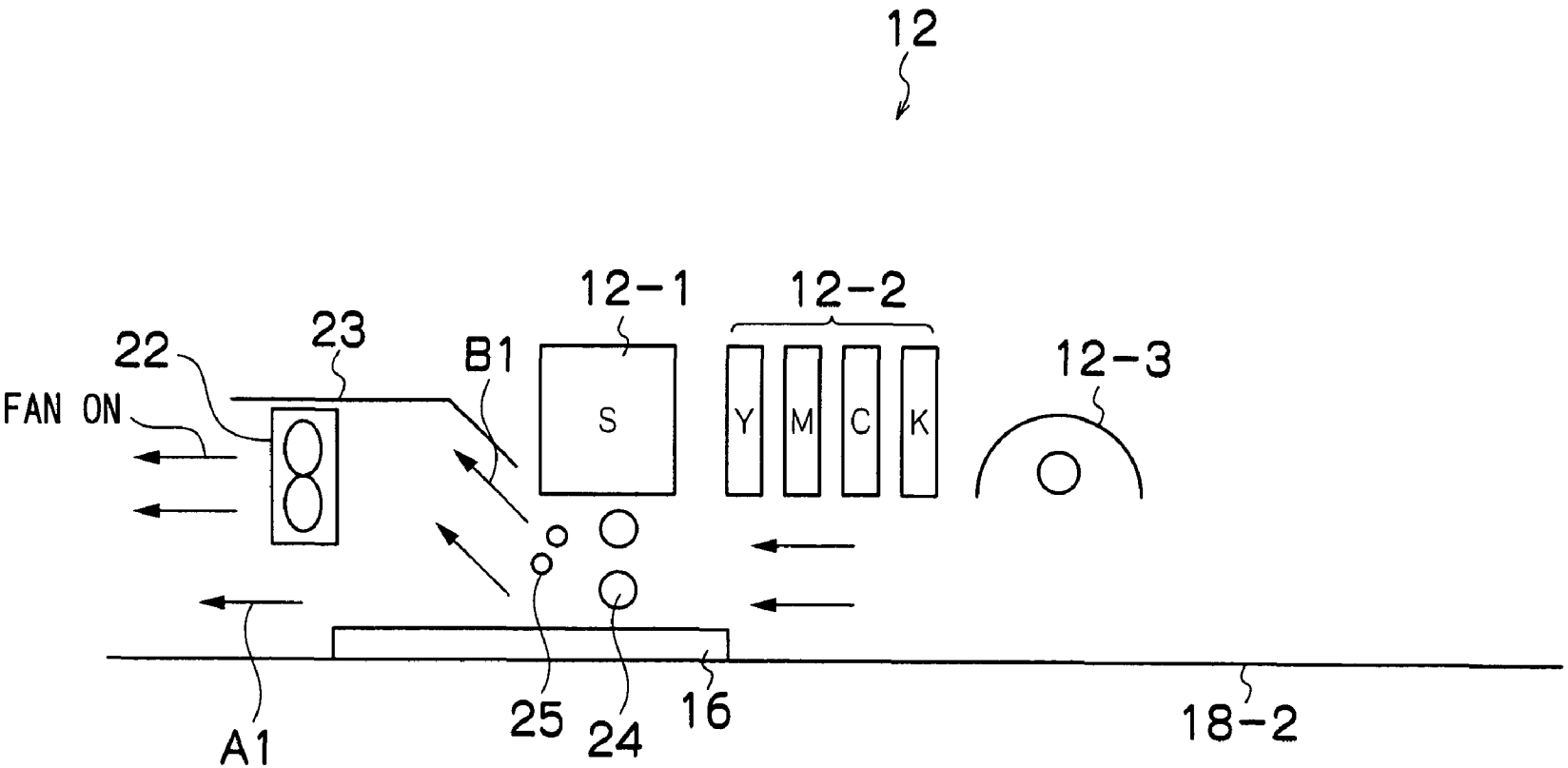
FIG. 6 is an enlarged diagram of the periphery of the print unit, showing a state during ejecting a first liquid from a first liquid head group toward a recording paper.

As shown in FIG. 6, when the recording paper 16 is conveyed further toward the left-hand side in FIG. 6, following the first conveyance direction A1, and arrives at a position directly below the first liquid head group 12-1, then a treatment liquid (first liquid) 24 containing a curing (polymerization) initiator is ejected from the treatment liquid head 12-1S constituting the first liquid head group 12-1, toward the recording paper 16.

In this case, a mist (first liquid mist) 25 of the treatment liquid (first liquid) is generated in the vicinity of the first liquid head group 12-1. Here, the airflow created by the conveyance of the recording paper 16 flows in the same direction as the conveyance direction A1 of the recording paper 16, as indicated by the arrow B11 in FIG. 6. Therefore, the first liquid mist 25 moves from the right-hand side to the left-hand side, following this current B1 of the airflow. Consequently, the first liquid mist 25 does not flow toward the side of the second liquid head group 12-2, and hence the occurrence of contamination on the nozzle surfaces of the second liquid head group 12-2 is prevented.

Moreover, in this case, if the fan 22 is switched on in order to recover the first liquid mist 25, then it is possible to achieve a better mist removing effect.

Figure 7:
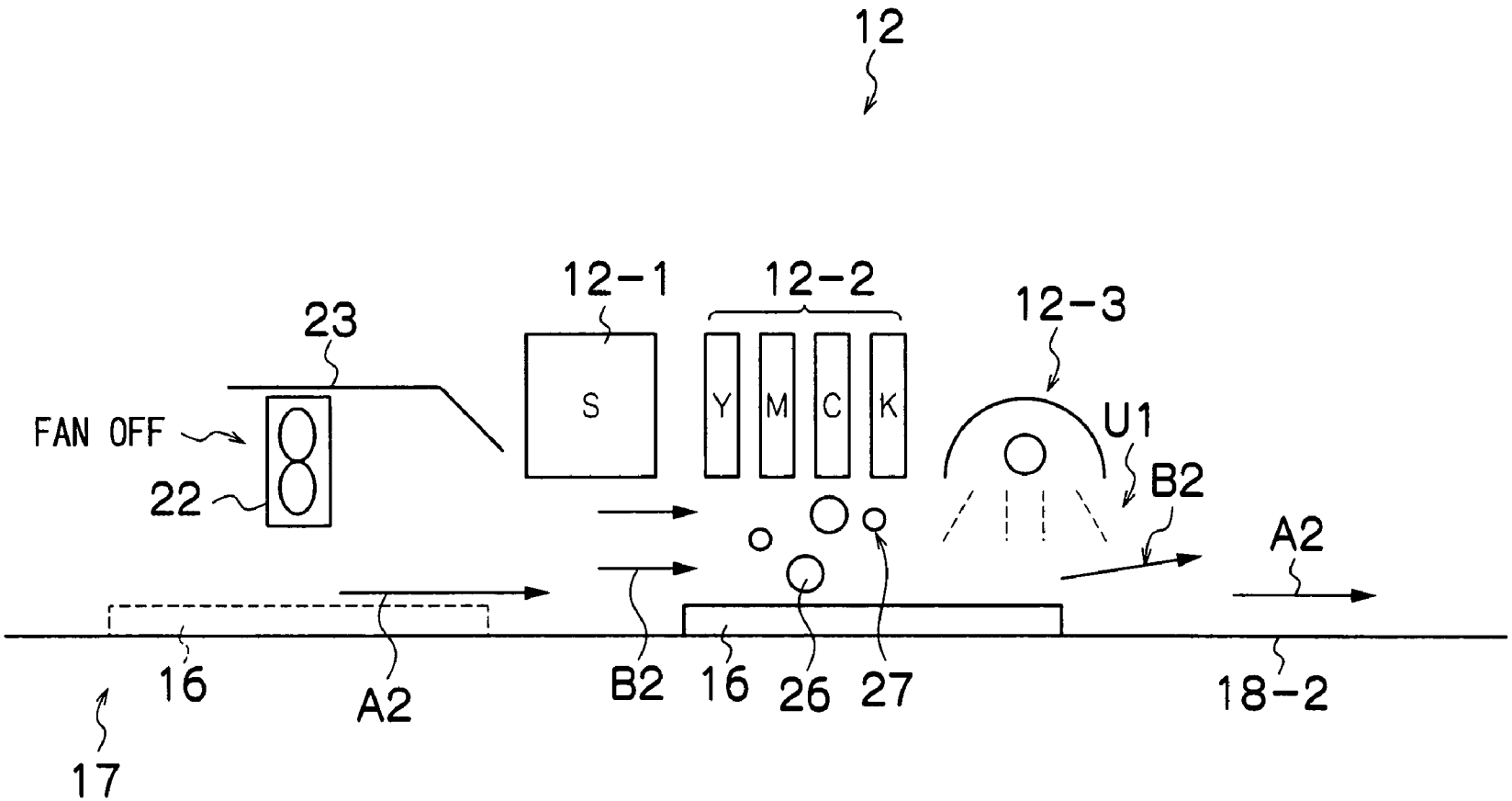
FIG. 7 is an enlarged diagram of the periphery of the print unit, showing a state during ejecting a second liquid from a second liquid head group toward the recording paper.

After ejecting treatment liquid from the treatment liquid head 12-1S of the first liquid head group 12-1, the recording paper 16 is conveyed to the switch-back unit 17 situated further beyond the first liquid head group 12-1 (situated in the further left-hand side in the drawings), as indicated by the dotted line in FIG. 7, and the conveyance is halted temporarily. If the fan 22 is being operated, then the fan 22 is switched off at this time.

Thereupon, in the switch-back unit 17, the conveyance direction of the recording paper 16 is reversed by 180°, and the conveyance is then restarted on the second conveyance path 18-2, in the second conveyance direction indicated by the arrow A2 in FIG. 7. In the second conveyance of the recording paper 16 with respect to the print unit 12, the recording paper 16 is conveyed below the print unit 12 from left to right in FIG. 7. When the recording paper 16 is conveyed directly below the first liquid head group 12-1, the first liquid head group 12-1 does not perform ejection and the recording paper 16 simply passes directly below the first liquid head group 12-1.

Thereupon, when the recording paper 16 is conveyed directly below the second liquid head group 12-2, as indicated by the solid line in FIG. 7, then colored inks (second liquids) 26, each of which contains a polymerizable compound, are respectively ejected from the print heads 12-2Y, 12-2M, 12-2C and 12-2K which constitute the second liquid head group 12-2.

In this case, ink mist (second liquid mist) 27 is generated in the periphery of the second liquid head group 12-2. Since the recording paper 16 is conveyed in the second conveyance direction A2 from the left-hand side to the right-hand side in FIG. 7, then the airflow caused by the conveyance of the recording paper 16 flows from left to right in FIG. 7, as indicated by the arrow B2. Therefore, the second liquid mist 27 does not reach the first liquid head group 12-1 which is positioned on the left-hand side of the second liquid head group 12-2.

Moreover, since ejection is not performed from the first liquid head group 12-1 when the recording paper 16 is conveyed in the second conveyance direction A2 in this way, then the first liquid mist 25 does not reach the second liquid head group 12-2.

In this way, the occurrence of contamination on the nozzle surface of each of the first liquid head group 12-1 and the second liquid head group 12-2 is prevented.

After the recording paper 16 has passed below the second liquid head group 12-2, the UV irradiation unit 12-3 irradiates the liquid on the recording medium 16 with ultraviolet light U1, and thereby cures the liquid on the recording medium 16. The recording paper 16 is then conveyed to the paper output unit 20 via the third conveyance path 18-3 (shown in FIG. 1).

Figure 8:
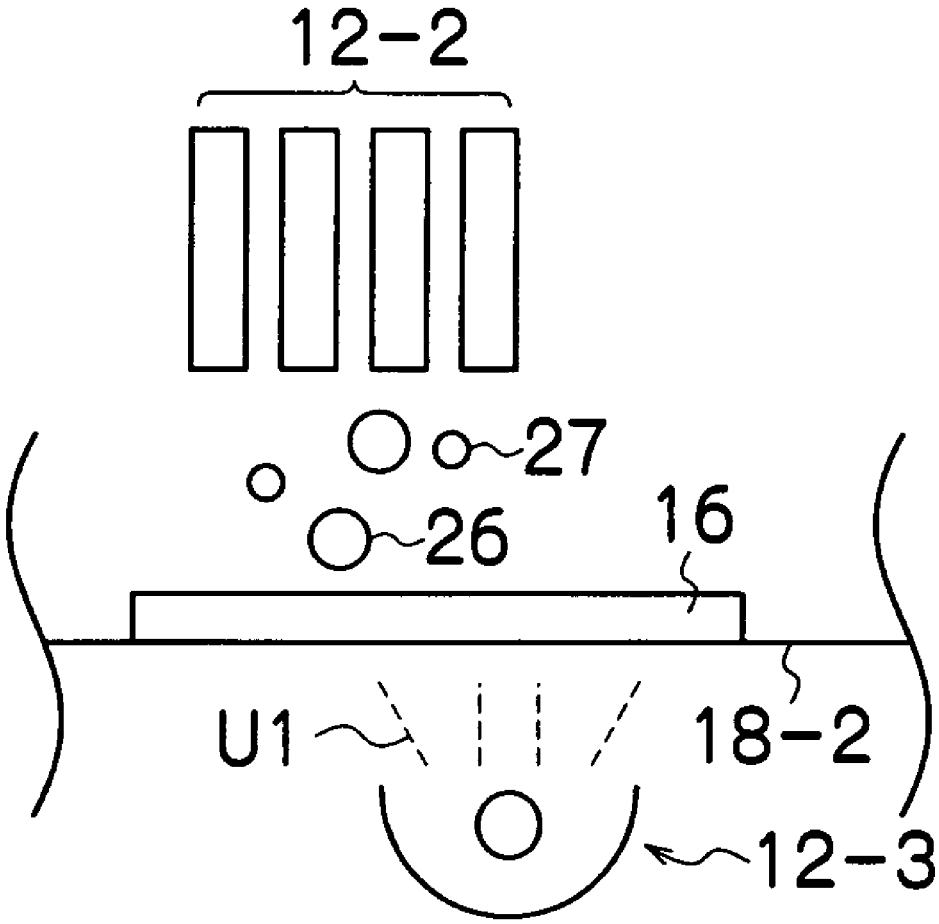
FIG. 8 is an enlarged diagram showing a further embodiment of the periphery of a print unit having another arrangement of the UV irradiation unit.

In the embodiment described above, the UV irradiation unit 12-3 is adjacent to the second liquid head group 12-2 (the UV irradiation unit 12-3 is disposed on the upstream side of the second liquid head group 12-2 in terms of the first conveyance direction A1, in other words, on the downstream side of the second liquid head group 12-2 in terms of the second conveyance direction A2). However, as shown in FIG. 8, it is also possible to dispose the UV irradiation unit 12-3 in a position directly below the second liquid head group 12-2, across the second conveyance path 18-2 from the second liquid head group 12-2.

In the present embodiment, since the first liquid mist does not reach the second liquid head group 12-2 and contamination does not occur as described above, then as shown in FIG. 8, even if ultraviolet light U1 is radiated from directly below the second liquid head group 12-2, the ink inside the nozzles of the second liquid head group 12-2 is not cured.

In this case, the recording medium (media) is limited to recording media having little absorption of ultraviolet light, such as a transparent medium and thin medium. However, in cases where the UV irradiation unit 12-3 is thus arranged across the second conveyance path 18-2 from the second liquid head group 12-2, it is possible to reduce the size and cost of the apparatus.

In this way, in the present embodiment, since liquid mist from one head group does not deposit onto the other head group, and vice versa, then curing of the ink due to contamination on the nozzle surface of the head is prevented. Hence, it is possible to suppress the need of head replacement due to nozzle blockages, or the like, and furthermore, the frequency of maintenance can be reduced, and increased productivity, reduced wastage of ink, and lower running costs can be anticipated.

Next, the action of the present embodiment described above is explained below once more with reference to a flowchart.

Figure 9:
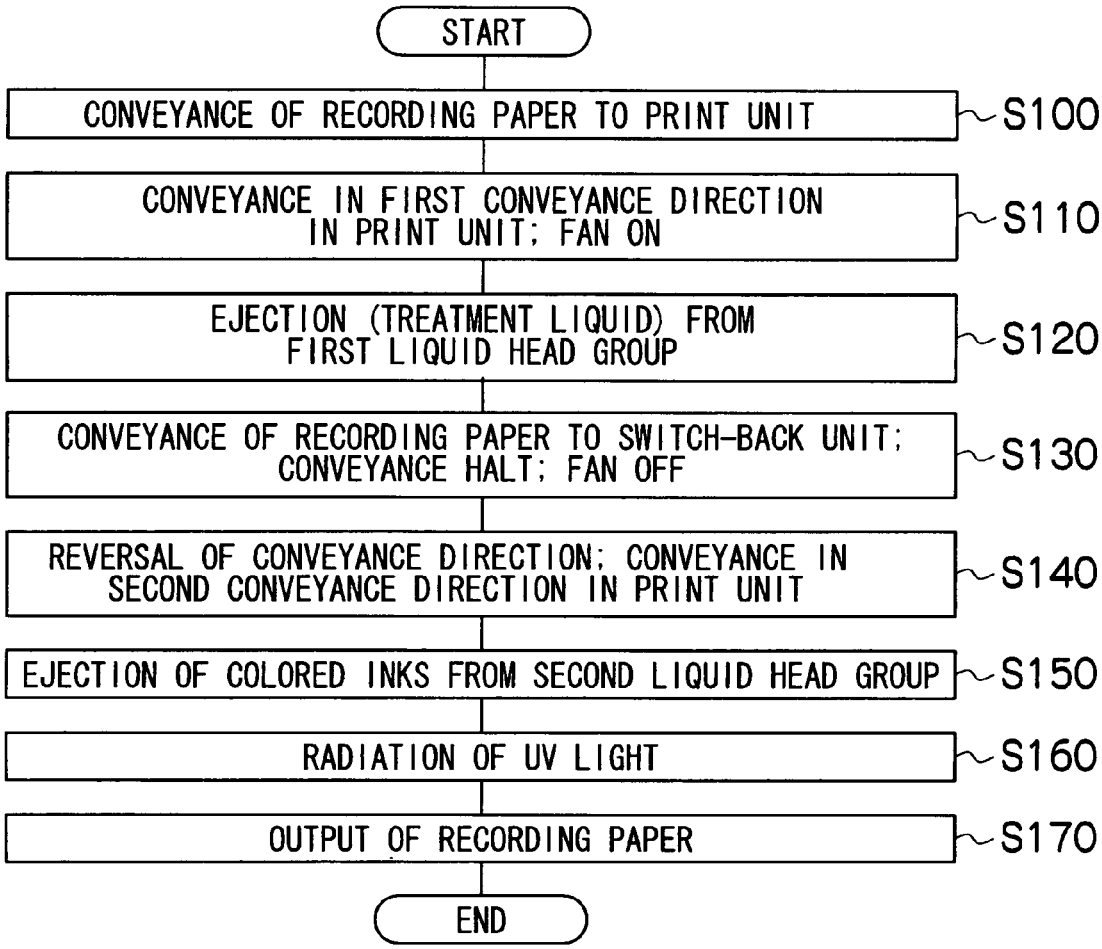
FIG. 9 is a flowchart showing a liquid ejection method according to the first embodiment.

FIG. 9 is a flowchart showing a liquid ejection method according to the present embodiment.

Firstly, at step S100 in FIG. 9, a recording paper 16 is extracted from the paper supply unit 14 and is conveyed to the print unit 12 via the first conveyance path 18-1.

Thereupon, at step S110, the recording paper 16 is conveyed on the second conveyance path 18-2 below the print unit 12, following the first conveyance direction in which the recording paper 16 has been conveyed from the paper supply unit 14, and then the fan 22 is switched on. As described above, the UV irradiation unit 12-3, the second liquid head group 12-2, the first liquid head group 12-1 (and the fan 22) are arranged in this order, from the upstream side, following the first conveyance direction (in other words, from the side adjacent to the paper supply unit 14). When the recording paper is conveyed below the print unit 12 in the first conveyance direction, the recording paper 16 initially reaches the second liquid head group 12-2. On this occasion, no ejection is performed from the second liquid head group 12-2 onto the recording paper 16, and the recording paper 16 simply passes below the second head group 12-2.

Thereupon, at step S120, when the recording paper 16 is conveyed directly below the first liquid head group 12-1, treatment liquid is ejected toward the recording paper 16 from the treatment liquid head 12-1S in the first liquid head group 12-1. Mist of the treatment liquid (first liquid) is generated in this step, but this mist is made to flow toward the downstream side in the first conveyance direction by the airflow created by the conveyance of the recording paper 16. Therefore, the mist does not reach the second liquid head group 12-2 positioned on the upstream side, and hence no contamination occurs on the nozzle surfaces of the second liquid head group 12-2.

Next, at step S130, the recording paper 16 is conveyed to the switch-back unit 17. The conveyance of the recording paper 16 is temporarily halted here. Furthermore, if the fan 22 is being used, then the fan 22 is switched off.

Thereupon, at step S140, the conveyance direction of the recording paper 16 is reversed by 180° and the recording paper 16 is conveyed along the second conveyance path 18-2 below the print unit 12, in the second conveyance direction, which is the exact opposite direction to the first conveyance direction. In this second conveyance below the print unit 12, the recording paper 16 initially reaches the first liquid head group 12-1. On this occasion, no ejection is performed from the first liquid head group 12-1.

Thereupon, at step S150, when the recording paper 16 is conveyed directly below the second liquid head group 12-2, the colored inks are respectively ejected from the print heads 12-2Y, 12-2M, 12-2C and 12-2K of the second liquid head group 12-2 onto the recording paper 16, thereby forming an image.

In this case, a mist of the second liquid is generated, but this mist is made to flow toward the downstream side of the second conveyance direction, by the airflow created by the conveyance of the recording paper 16. Therefore, the mist does not reach the first liquid head group 12-1, and hence the occurrence of contamination on the nozzle surface of the first liquid head group 12-1 is prevented.

Thereupon, at step S160, ultraviolet light is radiated from the UV irradiation unit 12-3, and the image formed on the recording paper 16 is thereby cured and fixed.

Finally, at step S170, the recording paper 16 on which an image has been recorded is conveyed to and output from the paper output unit 20.

As described above, in the present embodiment, the mist from either the first liquid head group 12-1 or the second liquid head group 12-2 does not reach the other of the head groups, and therefore it is possible to prevent contamination on the nozzle surfaces. Consequently, it is possible to achieve reduction in the maintenance frequency, reduction of wasted ink, and improvement in productivity. Moreover, increased head life, reduced head replacement frequency and more stable image quality can also be expected.

Next, a second embodiment of the present invention is described below.

The second embodiment has substantially the same overall composition and head composition as the first embodiment described above. Difference between the two embodiments is that a squeezing unit for squeezing excess first liquid deposited on the recording paper is provided immediately after the first head group, between the first head group and the fan in the composition of the embodiment described above.

Figure 10:
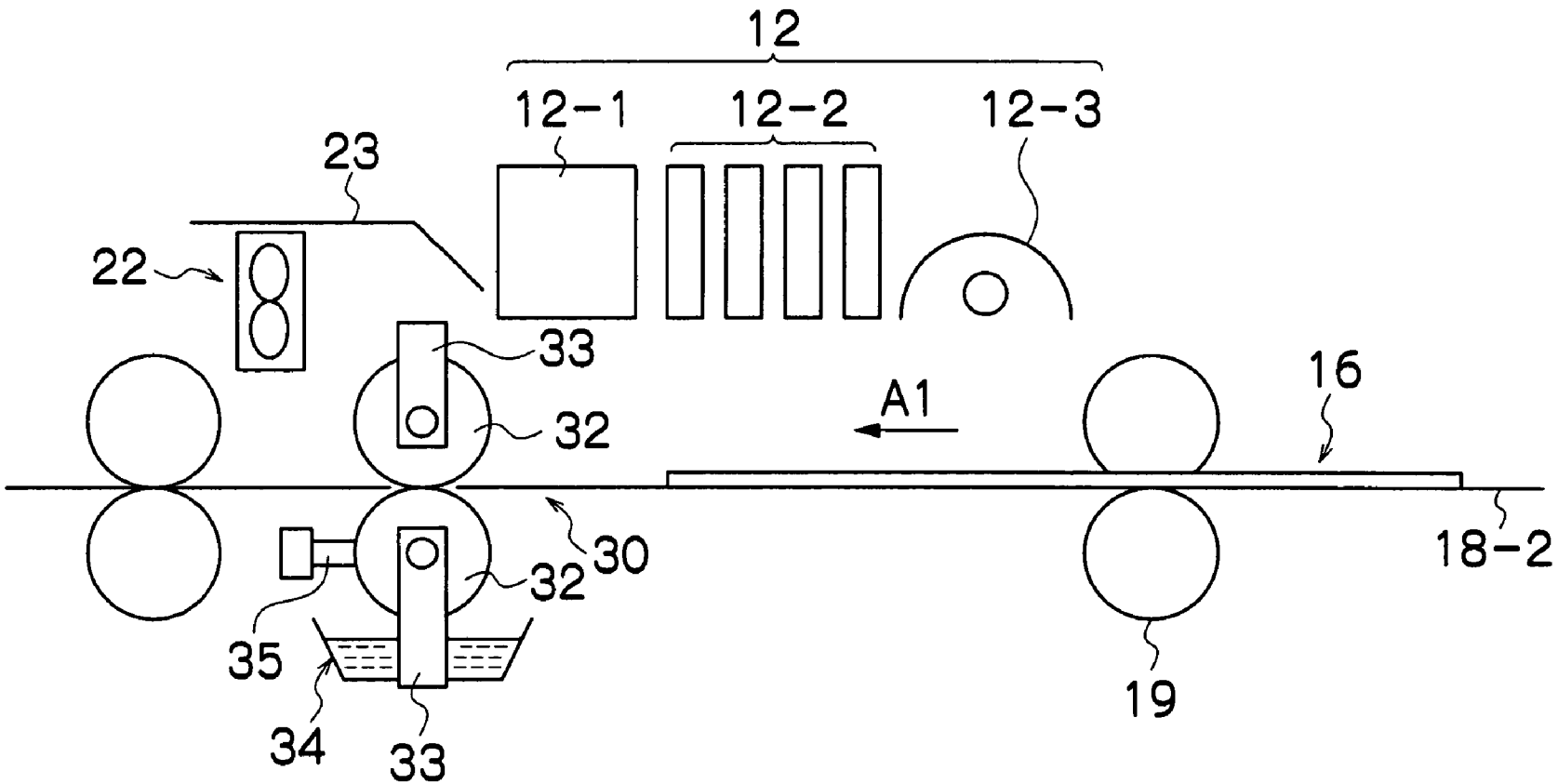
FIG. 10 is an enlarged diagram showing the periphery of a print unit provided with a squeezing unit in an inkjet recording apparatus according to a second embodiment of the present invention.

FIG. 10 is an enlarged diagram of the peripheral part of the print unit of the inkjet recording apparatus 10 according to the second embodiment.

As shown in FIG. 10, in the second embodiment also, the print unit 12 includes: a first liquid head group 12-1 for ejecting treatment liquid; a second liquid head group 12-2 for ejecting colored inks; and a UV (ultraviolet light) irradiation unit 12-3. The UV irradiation unit 12-3, the second liquid head group 12-2 and the first liquid head group 12-1 are disposed in this order from the upstream side (from the right-hand side in FIG. 10), following the first conveyance direction in which the recording paper 16 is conveyed below the print unit 12 for the first time, as indicated by the arrow A1 in FIG. 10.

Similarly to the first embodiment described above, a fan 22 and an air duct 23 for recovering the first liquid mist are provided on the downstream side of the print unit 12 in terms of the first conveyance direction.

Furthermore, in the present embodiment, a squeezing unit 30 is disposed between the print unit 12 and the fan 22, as shown in FIG. 10.

The squeezing unit 30 includes squeezing rollers 32 positioned on either side of the conveyance path (the second conveyance path 18-2) to squeeze the excess first liquid (treatment liquid) on the recording paper 16 by nipping the recording paper 16 from above and below. The squeezing rollers 32 which oppose each other across the conveyance path are respectively provided with elevator mechanisms 33. The recording paper 16 is nipped by means of the squeezing rollers 32 coming close, or the nip is released by means of the rollers 32 being moved apart, by the action of the elevator mechanisms 33.

Furthermore, a liquid recovering receptacle 34 for recovering the excess first liquid that has been squeezed out is disposed below the lower squeezing roller (which is situated on the lower side of the conveyance path) 32, at a position slightly distanced from the squeezing roller 32. The liquid recovering receptacle 34 is filled with cleaning liquid for the squeezing rollers 32. The cleaning liquid is supplied to the liquid recovering receptacle 34 via tubing channels (not shown).

Moreover, a cleaning unit 35 for wiping away cleaning liquid and soiling attached to the surface of the lower squeezing roller 32 is provided in order to prevent the rear surface of the recording paper 16 from being soiled by the lower squeezing roller 32. There are no particular restrictions on the composition of the cleaning unit 35, and it is, for example, possible to wipe the surface of the squeezing roller 32 by means of a soft material, such as a felt material.

The squeezing rollers 33 in the squeezing unit 30 extend the first liquid (treatment liquid) which has been deposited on the recording paper 16 by ejection from the first liquid head group 12-1, and distribute the first liquid uniformly over the recording paper 16. The squeezing rollers 33 also serve to squeeze out the excess first liquid. The first liquid squeezed out passes through the lower squeezing roller 33, and it is collected in the liquid recovering receptacle 34 provided below the lower squeezing roller 33. The liquid collected in the liquid recovering receptacle 34 is conveyed out from the liquid recovering receptacle 34 by means of a tubing channel (not shown in FIG. 10) described above, and therefore, the pair of squeezing rollers 33 are kept in a clean state at all times.

Next, the operation of the liquid ejection method according to the present embodiment is described below.

Firstly, as shown in FIG. 10, similarly to the first embodiment described above with reference to FIG. 5, the recording paper 16 is conveyed in the first conveyance direction from right to left in FIG. 10 as indicated by the arrow A1, along the second conveyance path 18-2 below the print unit 12, while being gripped between a pair of conveyance rollers 19. In this case, ejection is not performed from the second liquid head group 12-2 while the paper passes directly below the second liquid head group 12-2. The pair of squeezing rollers 33 wait in a nipped state for the recording paper 16 to be conveyed. By causing the squeezing rollers 32 to rotate during this time, pre-cleaning is carried out in order to clean the surfaces of the squeezing rollers 32.

Figure 11:
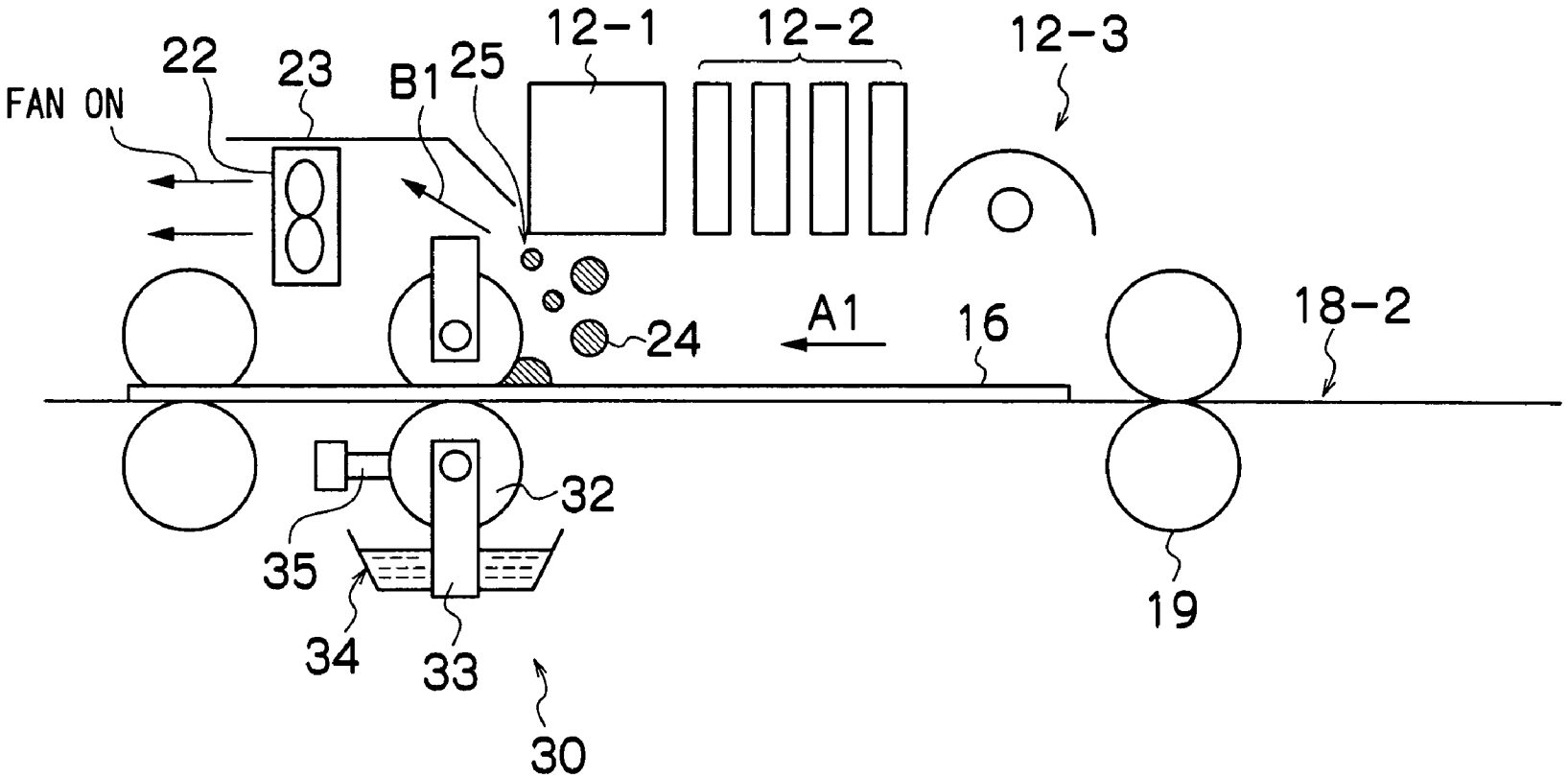
FIG. 11 is an enlarged diagram of the periphery of the print unit, showing a state during ejecting a first liquid from a first liquid head group according to the second embodiment.

Next, as shown in FIG. 11, the recording paper 16 is conveyed further to the left-hand side via the second conveyance path 18-2, and when it comes to a position directly below the first liquid head group 12-1, first liquid (treatment liquid) 24 is ejected from the first liquid head group 12-1. In this case, mist (first liquid mist) 25 of the treatment liquid (first liquid) is generated at the perimeter of the first liquid head group 12-1. The mist 25 is recovered in the same manner as the first embodiment described above.

In other words, an airflow is created as indicated by the arrow B1 due to the conveyance of the recording paper 16 (in the first conveyance direction indicated by the arrow A1), and the mist 25 moves toward the downstream side in the first conveyance direction. Consequently, the mist 25 of the first liquid does not reach the second liquid head group 12-2. Furthermore, the mist removal effects are further increased by switching the fan 22 on.

When the recording paper 16 makes contact with the pair of squeezing rollers 32 which are in the nipped state, the first liquid (treatment liquid) on the recording paper 16 is spread out, and excess first liquid is squeezed out. When the recording paper 16 is released from the pair of squeezing rollers 32, the first liquid squeezed out is recovered, via the lower squeezing roller 32, to the liquid recovering receptacle 34 provided below the lower squeezing roller 32, and it is diluted with the cleaning liquid.

Figure 12:
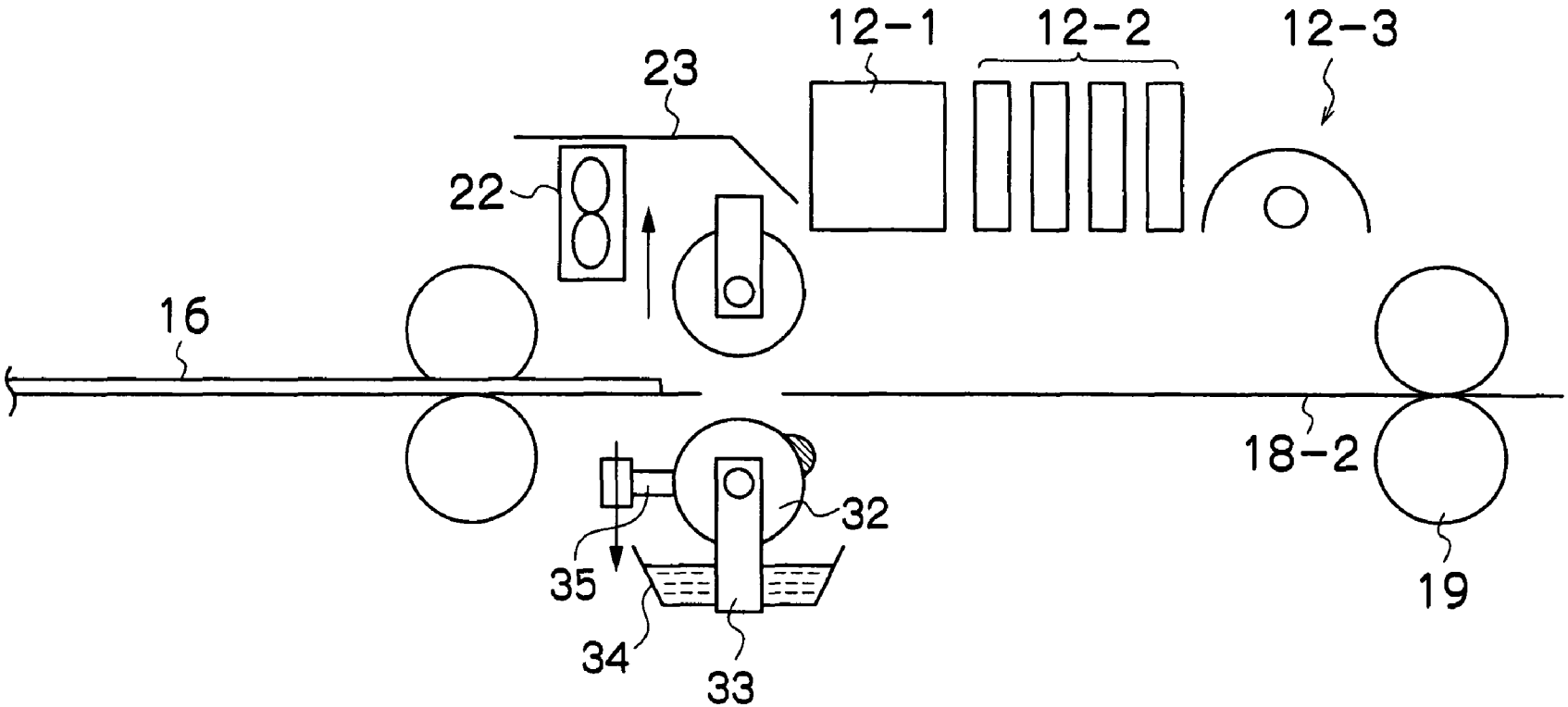
FIG. 12 is an enlarged diagram of the periphery of the print unit, showing a state during reversal of the conveyance direction of the recording paper, according to the second embodiment.

Thereupon, as indicated by the arrows in FIG. 12, the nip between the pair of squeezing rollers 32 is released by means of the elevator mechanisms 33. Moreover, the recording paper 16 is conveyed to the switch-back unit 17 (which is shown in FIG. 1 rather than FIG. 12), which is positioned further to the left-hand side, and the conveyance direction is reversed by 180°.

Figure 13:
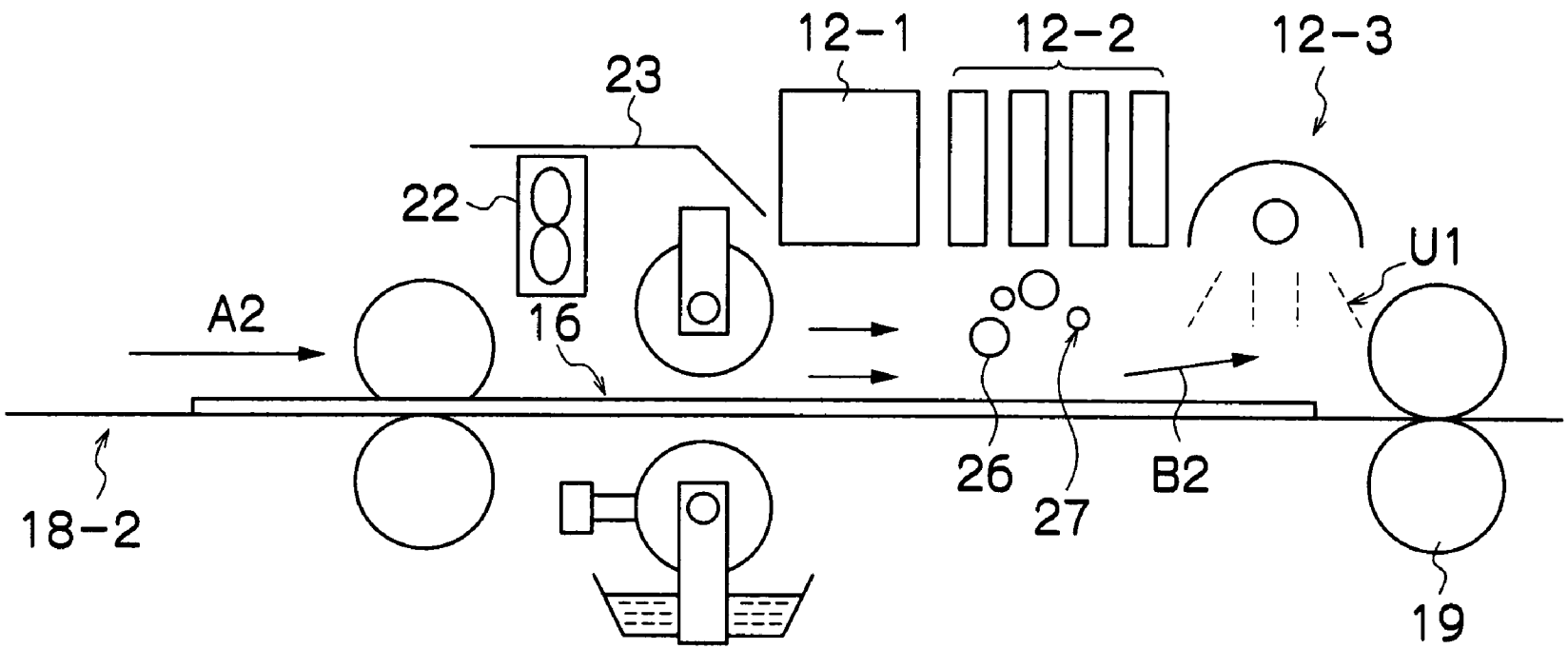
FIG. 13 is an enlarged diagram of the periphery of the print unit, showing a state during ejecting a second liquid from a second liquid head group according to the second embodiment.

Thereupon, as shown in FIG. 13, the recording paper 16 is conveyed in the second conveyance direction after the conveyance direction is reversed, as indicated by the arrow A2, and the recording paper 16 passes below the print unit 12 from left to right in FIG. 13. On this occasion, since the pair of squeezing rollers 32 are separated from each other in the vertical direction, then the recording paper 16 does not make contact with the squeezing rollers 32. Hence, there is no occurrence of image deterioration, such as non-uniformities, due to repeated contact with these rollers.

When the recording paper 16 is conveyed in the second conveyance direction and the recording paper 16 passes directly below the first liquid head group 12-1, no ejection is performed from the first liquid head group 12-1. On the other hand, when the recording paper 16 passes directly below the second liquid head group 12-2, the colored inks 26 are ejected from the second liquid head group 12-2. In this case, second liquid mist 27 is generated, but due to the conveyance of the recording paper 16 in the second conveyance direction as indicated by the arrow A2 in FIG. 13, airflow is created so as to have an airflow direction indicated by the arrow B2 in FIG.

13. Consequently, the second liquid mist 27 flows in the rightward direction and does not reach the first liquid head group 12-1.

Subsequently, ultraviolet light U1 is radiated from the UV irradiation unit 12-3, thereby curing the ink on the recording paper 16 and fixing the image. The recording paper 16 on which an image has been formed is output to the exterior from the paper output unit 20.

In this way, in the second embodiment, immediately after deposition of the first liquid, the first liquid is spread out uniformly and surplus first liquid is squeezed by the squeezing unit. Thereby, it is possible to ensure the stability of ejection of the first liquid head group, and consequently, improvement in image quality can be expected. Moreover, it is possible to extend the first liquid uniformly by means of the squeezing unit even if the ejection from the first liquid head group is not uniform, and therefore it is not necessary to achieve such high ejection accuracy in the first liquid head group, and hence costs can be reduced.

In the first embodiment and the second embodiment described above, treatment liquid containing a UV curing initiator is used in the first liquid head group, and inks containing a polymerizable compound and a coloring material are used in the second liquid head group, but the combination of the first liquid and the second liquid is not limited to this.

For example, it is also possible to combine the use of a treatment liquid containing an aggregating agent, in the first liquid head group, with an ink containing coloring material and an aggregation material that becomes aggregated by the aggregating agent, in the second liquid head group. In this case, aggregation starts due to the reaction between the two liquids, simply by mixing the two liquids together, and the ink solidifies. In this case, the UV irradiation unit is not necessary.

Alternatively, it is also possible to adopt a combination of inks in which colored inks are used in both the first liquid head group and the second liquid head group. In this case, contamination may occur between the different colors; therefore if the present invention is applied to this case, the beneficial effects of adopting the present invention are still obtained.

Next, a double-side printing method and an image forming apparatus for double-side printing according to the present invention are described below in detail.

Figure 14:
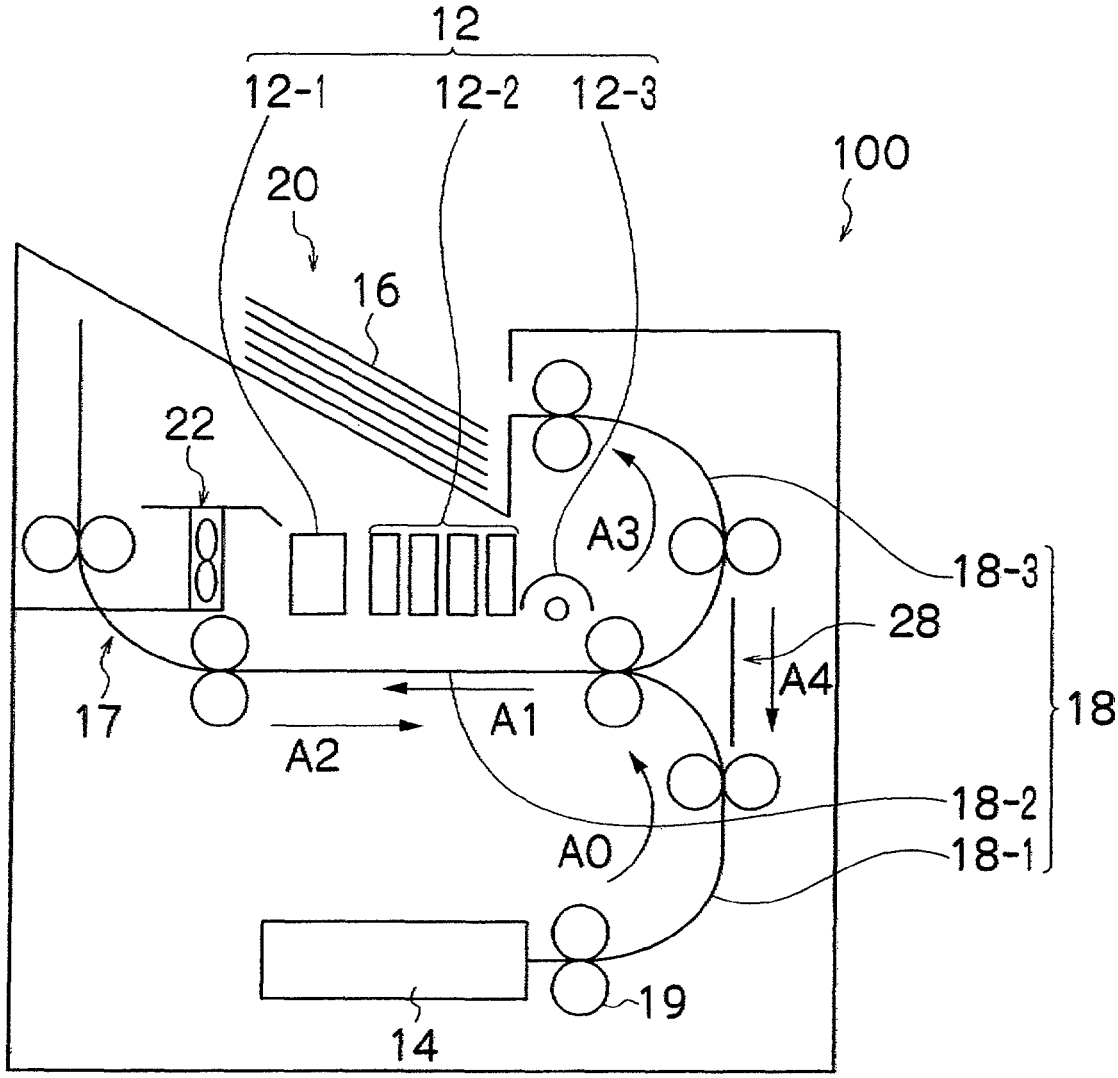
FIG. 14 is a general compositional diagram showing an approximate view of an inkjet recording apparatus forming an image forming apparatus for double-side printing according to a third embodiment of the present invention.

FIG. 14 is a general compositional diagram showing an approximate view of an inkjet recording apparatus serving as an image forming apparatus for double-side printing according to a third embodiment of the present invention. In the inkjet recording apparatus according to the third embodiment which uses inks of a two-liquid reaction system, it is possible to carry out double-side printing as well as preventing the occurrence of contamination on the nozzle surfaces of the heads (hereinafter, simply referred to as "contamination"). The inkjet recording apparatus according to the present embodiment has a substantially similar composition to the inkjet recording apparatus according to the first embodiment of the present invention shown in FIG. 1; however, in the present embodiment, an inverting unit 28 is added in order to enable double-side printing.

As shown in FIG. 14, the inkjet recording apparatus 100 according to the present embodiment comprises: a print unit 12 including a first liquid head group (first ejection head) 12-1 which ejects treatment liquid as a first liquid, a second liquid head group (second ejection head) 12-2 which ejects colored inks as second liquids, a UV (ultraviolet light) irradiation unit (radiation irradiation unit) 12-3; a paper supply unit 14 which supplies recording paper 16 to the print unit 12; a conveyance unit 18 which conveys the recording paper 16; and a paper output unit 20 which outputs the recorded recording paper 16 to the exterior.

In FIG. 14, the paper supply unit 14 is depicted as a cassette (media stacker) in which cut paper sheets are stacked and loaded, but the paper supply unit 14 is not limited in particular to this. It is also possible to supply the recording paper 16 by means of a magazine which accommodates rolled paper (continuous paper). If rolled paper is used, then a cutter should be disposed immediately on the downstream side of the magazine, in such a manner that the rolled paper extracted from the magazine is cut to a desired size with the cutter and is then conveyed for use. Furthermore, if rolled paper is used, then the paper retains residual curl due to having been loaded in a rolled state in the magazine, and therefore, in order to remove this curl, for example, it is desirable to provide a decurling unit which applies heat to the recording paper 16 by means of a heating drum, in the direction opposite to the direction in which the paper is rolled in the magazine.

The conveyance unit 18 includes: a first conveyance path 18-1 along which the recording paper 16 is conveyed from the paper supply unit 14 to the print unit 12; a second conveyance path 18-2 along which the recording paper 16 is conveyed directly below the print unit 12; a switch-back unit 17 which reverses the direction of conveyance of the recording paper 16 that has passed below the print unit 12; an inverting unit 28 constituted by a conveyance guide for inverting the front surface/rear surface orientation of the printed recording paper 16; and a third conveyance path 18-3 along which the printed recording paper 16 is conveyed to the paper output unit 20. Pairs of conveyance rollers 19 for conveying the recording paper 16 are respectively disposed at prescribed positions for each of the conveyance paths 18-1 to 18-3.

As indicated by the arrow A0 in FIG. 14, the recording paper 16 supplied from the paper supply unit 14 is conveyed to the print unit 12 via the first conveyance path 18-1. The recording paper 16 conveyed to the print unit 12 is conveyed along the second conveyance path 18-2, initially (for the first time) from right to left (the first conveyance direction) directly below the print unit 12, as indicated by the arrow A1 in FIG. 14, until reaching the switch-back unit 17.

The recording paper 16 conveyed to the switch-back unit 17 is halted temporarily, the conveyance direction is reversed to the opposite direction, and it is then conveyed back toward the print unit 12 through the second conveyance path 18-2, this time in the opposite direction. In other words, when passing the print unit 12 for the second time, the recording paper 16 is conveyed from left to right (the second conveyance direction) directly below the print unit 12, as indicated by the arrow A2 in FIG. 14.

The second conveyance path 18-2 is composed so that the recording paper 16 is conveyed in such a manner that the portion thereof opposing the nozzle surfaces (not illustrated) of all heads of the print unit 12 is kept flat. As described above, in the third embodiment, the recording paper 16 is conveyed twice below the print unit 12 by reversing the conveyance direction. In this case, printing is performed onto the front surface of the recording paper 16 by the print unit 12.

After printing onto the front surface of the recording paper 16 has been completed, the recording paper 16 is conveyed to the third conveyance path 18-3, as indicated by the arrow A3 in FIG. 14, and then conveyed to the first conveyance path 18-1 via the inverting unit 28. The recording paper 16 is then fed back to the print unit 12. In this case, the recording paper 16 is conveyed to the second conveyance path 18-2 while the recording paper 16 are inverted. Similarly to when printing on the front surface, the recording paper 16 is passed below the print unit 12 twice via the second conveyance path 18-2, in both the direction indicated by the arrow A1 and the direction indicated by the arrow A2, and printing is carried out onto the rear surface. The double-side printing procedure is described in detail below.

The recording paper (the printed matter) 16 after double-side printing is conveyed to the paper output unit 20 via the third conveyance path 18-3, as indicated by the arrow A3 in FIG. 14, and it is then output from the paper output unit 20. Desirably, a sorter for collecting images according to print orders is provided in the paper output unit 20.

As shown in FIG. 14, in the print unit 12 according to the present embodiment, the UV irradiation unit 12-3, the second liquid head group 12-2 and the first liquid head group 12-1 are arranged in this order along the second conveyance path 18-2, from the upstream side in terms of the first conveyance direction A1. Moreover, a fan 22 for inhaling (recovering) liquid mist produced by the liquid ejection from the first liquid head group 12-1 and the second liquid head group 12-2 is disposed on the downstream side of the print unit 12 in terms of the first conveyance direction A1, in other words, on the downstream side of the first liquid head group 12-1.

The composition of the print unit 12 according to the third embodiment is similar to that of the first embodiment described above with reference to FIG. 2. The structure of each of the heads constituting the print unit 12 is similar to that of the first embodiment described above with reference to FIG. 3. Moreover, the liquid supply system in the inkjet recording apparatus 100 according to the present embodiment is similar to that of the first embodiment described above with reference to FIG. 4.

In the present embodiment, printing is carried out onto both sides of the recording paper 16, and the method for printing onto each side (the front surface or the rear surface) of the recording paper 16 is similar to the first embodiment shown in FIGS. 5 to 8.

More specifically, as shown in FIG. 5, when the recording paper 16 is passed below the print unit 12 for the first time (from right to left in FIG. 5) following the first conveyance direction A1, inks are not ejected from the second liquid head group 12-1, and when the recording paper 16 arrives at a position directly below the first liquid head group 12-1 as shown in FIG. 6, then the treatment liquid (first liquid) 24 containing a curing (polymerization) initiator is ejected from the first liquid head group 12-1 toward the recording paper 16.

Thereupon, as shown in FIG. 7, the conveyance direction of the recording paper 16 is reversed by 180° by means of the switch-back unit 17, and the recording paper 16 is then conveyed in the second conveyance direction A2. When the recording paper 16 comes to a position directly below the second liquid head group 12-2, then colored inks (second liquids) 26 containing polymerizable compounds are ejected from the second liquid head group 12-2.

After the recording paper 16 has passed below the second liquid head group 12-2, ultraviolet light U1 is radiated from the UV irradiation unit 12-3, thereby curing the liquid on the recording paper 16 and thus completing the printing (image recording) onto one side of the recording paper 16. If this printing has been performed onto the front surface of the recording paper 16, then the recording paper 16 is conveyed to the third conveyance path 18-3 (shown in FIG. 14) and the recording paper 16 is then conveyed to the first conveyance path 18-1 via the inverting unit 28, thereby inverting the recording paper 16. Thereupon the recording paper 16 is conveyed again to the print unit 12. On the other hand, after the printing onto the rear surface of the recording paper 16 is completed, the recording paper 16 is conveyed from the third conveyance path 18-3 to the paper supply unit 20.

In the third embodiment, curing of ink due to the occurrence of contamination on the nozzle surfaces of the respective heads can be prevented, similarly to the first embodiment described above in which single-side printing onto the recording paper 16 is implemented.

Next, a method of double-side printing which prevents contamination according to the present embodiment is described below.

FIGS. 15A to 16E are diagrams showing the sequence of steps of a double-side printing method according to the present embodiment.

Figure 15A:
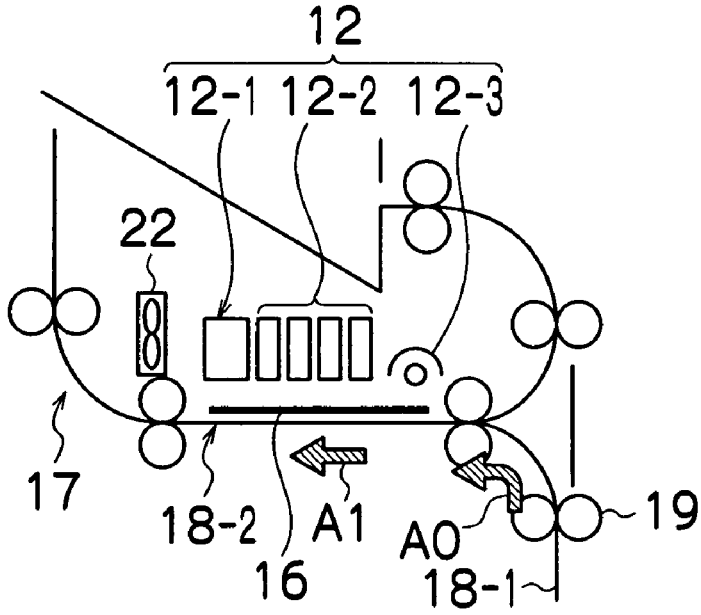
FIGS. 15A to 15E are process step diagrams showing a double-side printing method according to the third embodiment.

Firstly, as shown in FIG. 15A, the recording paper 16 supplied from the paper supply unit 14 (shown in FIG. 14 rather than FIG. 15A) is conveyed as indicated by the arrow A0 from the first conveyance path 18-1 to the second conveyance path 18-2. The recording paper 16 is then conveyed on the second conveyance path 18-2 as indicated by the arrow A1.

In this case, the recording paper 16 is conveyed from right to left in FIG. 15A (in the first conveyance direction) via the second conveyance path 18-2 as indicated by the arrow A1, and it passes sequentially below the UV irradiation unit 12-3, the second liquid head group 12-2 and the first liquid head group 12-1 of the print unit 12. On this occasion, liquid ejection is not performed by the second liquid head group 12-2 when the recording paper 16 passes below the second liquid head group 12-2, whereas when the recording paper 16 passes below the first liquid head group 12-1, only the first liquid containing a curing initiator is ejected from the first liquid head group 12-1.

In this case, similarly to the first embodiment shown in FIG. 6, a first liquid mist produced in the periphery of the first liquid head group 12-1 is carried in the direction (toward the left-hand side) which is the same as the conveyance direction of the recording paper 16, due to the airflow created by the conveyance of the recording paper 16. Therefore, the first liquid mist does not move toward the second liquid head group 12-2 and hence the occurrence of contamination on the nozzle surfaces of the second liquid head group 12-2 is prevented. Moreover, if the first liquid mist is recovered by means of the fan 22 in this case, then an even better mist removal effect can be achieved.

Figure 15B:
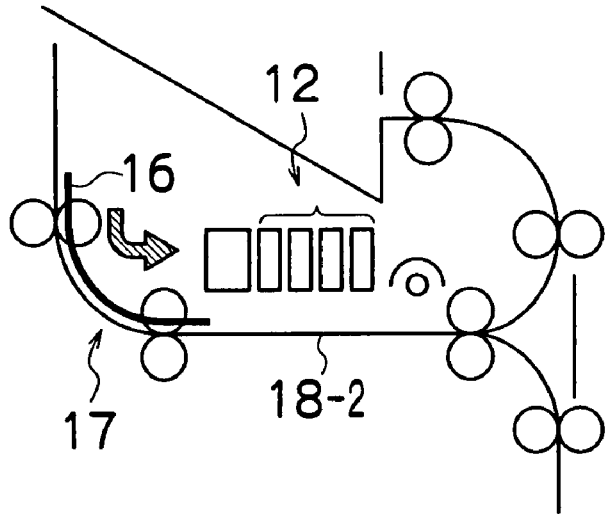

Thereupon, as shown in FIG. 15B, the recording paper 16 on which the first liquid has been deposited is conveyed to the switch-back unit 17. The conveyance direction is reversed as indicated by the arrow in FIG. 15B in the switch-back unit 17, and the paper is then conveyed again to the second conveyance path 18-2.

Figure 15C:
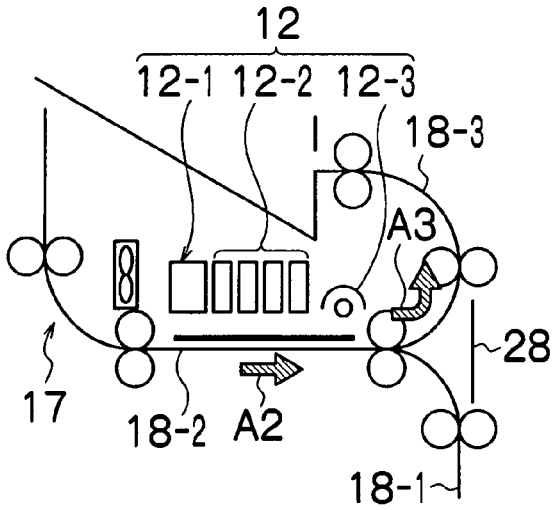

As shown in FIG. 15C, on this occasion, the recording paper 16 is conveyed from left to right as indicated by the arrow A2 (in the second conveyance direction) through the second conveyance path 18-2. When the recording paper 16 is conveyed from left to right in this way, the first liquid is not ejected from the first liquid head group 12-1. On the other hand, colored inks (second liquids) containing polymerizable compounds are ejected from the second liquid head group 12-2, when the recording paper 16 passes below the second liquid head group 12-2.

In this case also, a second liquid mist is generated from the second liquid head group 12-2. However, the second liquid mist is made to flow toward the right-hand side by the airflow due to the conveyance of the recording paper 16, and therefore the second liquid mist does not reach the first liquid head group 12-1. Consequently, contamination does not occur on the nozzle surfaces of the first liquid head group 12-1.

After ejecting the colored inks, the liquid on the recording paper 16 is cured by radiating ultraviolet light from the irradiation unit 12-3, thereby completing image recording onto the first surface of the recording paper 16. Subsequently, the recording paper 16 which has received recording on the first surface is conveyed to the third conveyance path 18-3 as indicated by the arrow A3 in FIG. 15C.

Figure 15D:
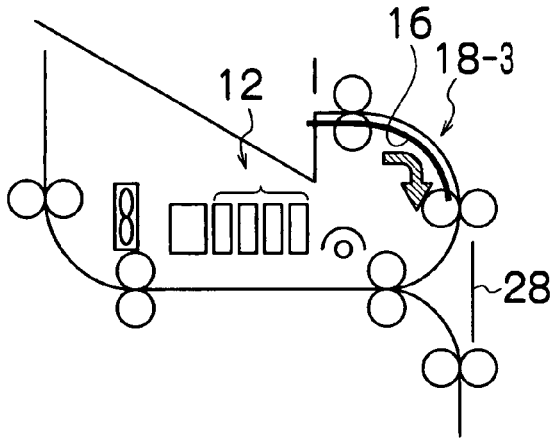

Thereupon, as shown in FIG. 15D, the conveyance direction of the recording paper 16 conveyed to the third conveyance path 18-3 and recorded on the first surface, is reversed, as indicated by the arrow in FIG. 15D.

Figure 15E:
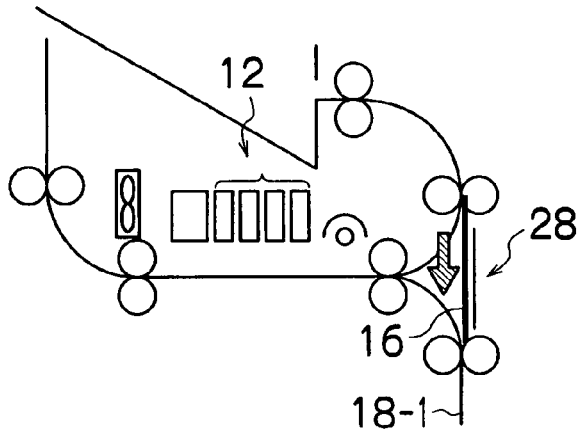

Next, as shown in FIG. 15E, the recording paper 16 is conveyed from the third conveyance path 18-3 toward the first conveyance path 18-1, through the inverting unit 28.

Figure 16A:
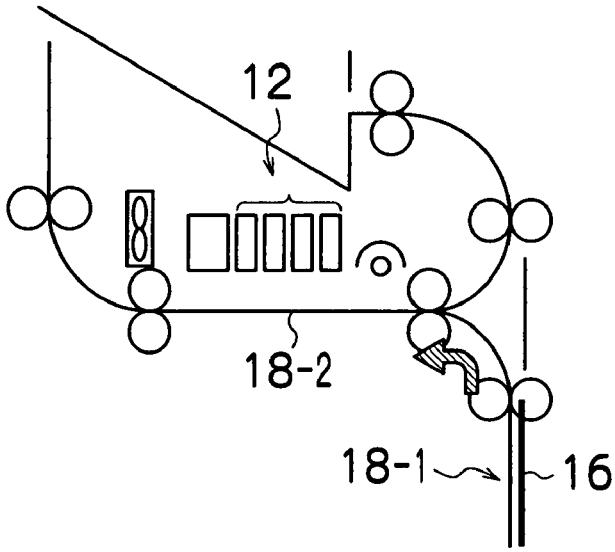
FIGS. 16A to 16E are also process step diagrams showing a double-side printing method according to the third embodiment.

Subsequently, as shown in FIG. 16A, the conveyance direction of the recording paper 16 conveyed to the first conveyance path 18-1 is reversed, as indicated by the arrow in FIG. 16A. The recording paper 16 is then conveyed again to the second conveyance path 18-2, with the second surface thereof facing the print unit 12, in order to perform image recording onto the second surface which has not yet received recording. An image is recorded onto the second surface in a similar fashion to FIGS. 15A to 15C.

Figure 16B:
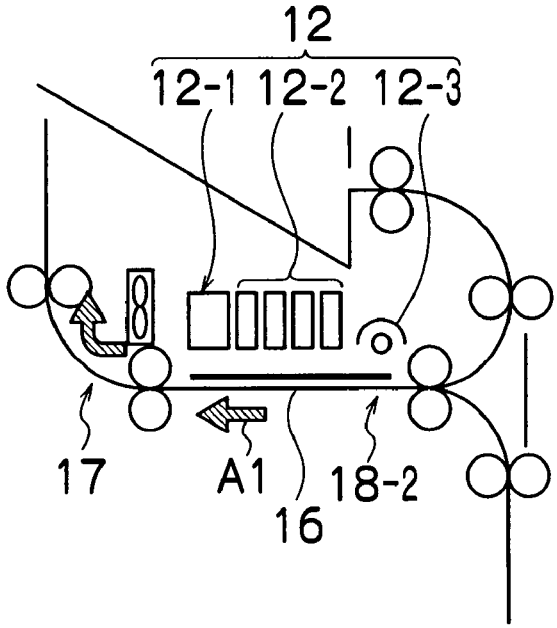

More specifically, as shown in FIG. 16B, when the recording paper 16 is conveyed from right to left following the second conveyance path 18-2, as indicated by the arrow A1 (in the first conveyance direction), only the first liquid is ejected from the first liquid head group 12-1, and the paper is conveyed to the switch-back unit 17.

Figure 16C:
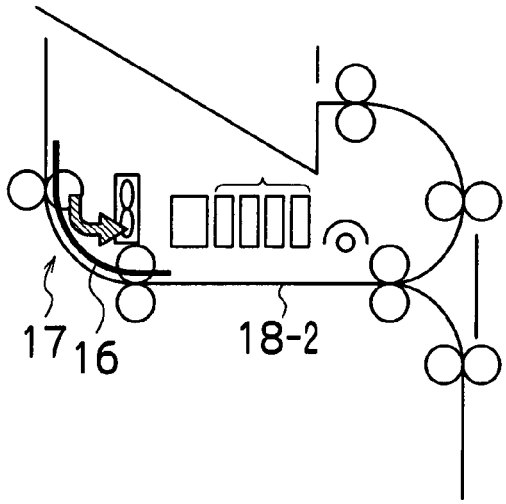

Thereupon, as indicated by the arrow in FIG. 16C, the conveyance direction is reversed by the switch-back unit 17, and the recording paper 16 is then conveyed again to the second conveyance path 18-2.

Figure 16D:
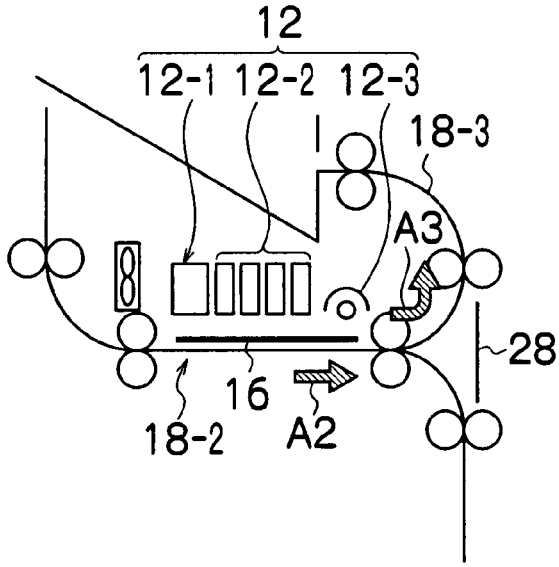

As shown in FIG. 16D, the recording paper 16 is conveyed from left to right in the drawing (in the second conveyance direction), as indicated by the arrow A2. The first liquid is not ejected from the first liquid head group 12-1, whereas the colored inks (second liquids) are ejected toward the second surface of the recording paper 16 from the second liquid head group 12-2.

When an image is thus printed onto the second surface (rear surface) with the recording paper 16 being conveyed from left to right, the print direction for the second surface is opposite to the print direction for the first surface (front surface) (in other words, the recording paper 16 is conveyed to the second liquid head group 12-2 in a state where the second surface of the recording paper 16 faces upward (the print heads) and the image on the first surface is upside down in relation to the second conveyance direction). Therefore, if an image is sought to be printed in the same manner as when printing on the first surface, then the image on the second surface is upside down in relation to the image on the first surface. Consequently, when printing an image on the second surface, the image data must be converted by carrying out image processing in order that the image is printed in the opposite direction in terms of the conveyance direction in comparison with printing on the first surface.

After ejecting the colored inks in this way, the liquid is cured by radiating ultraviolet light from the irradiation unit 12-3 onto the recording paper 16. The recording paper 16 is then conveyed to the third conveyance path 18-3 as indicated by the arrow A3.

Figure 16E:
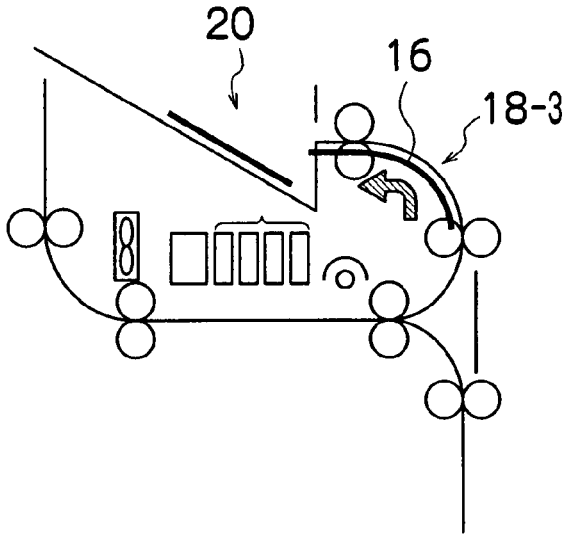

As shown in FIG. 16E, the recording paper 16 is then output from the third conveyance path 18-3 to the paper output unit 20 and it is collected in the paper output unit 20.

In this way, according to the present embodiment, it is possible to record images onto both surfaces of the recording paper 16, while preventing contamination on the heads.

Next, a fourth embodiment of the present invention is described below.

Figure 17:
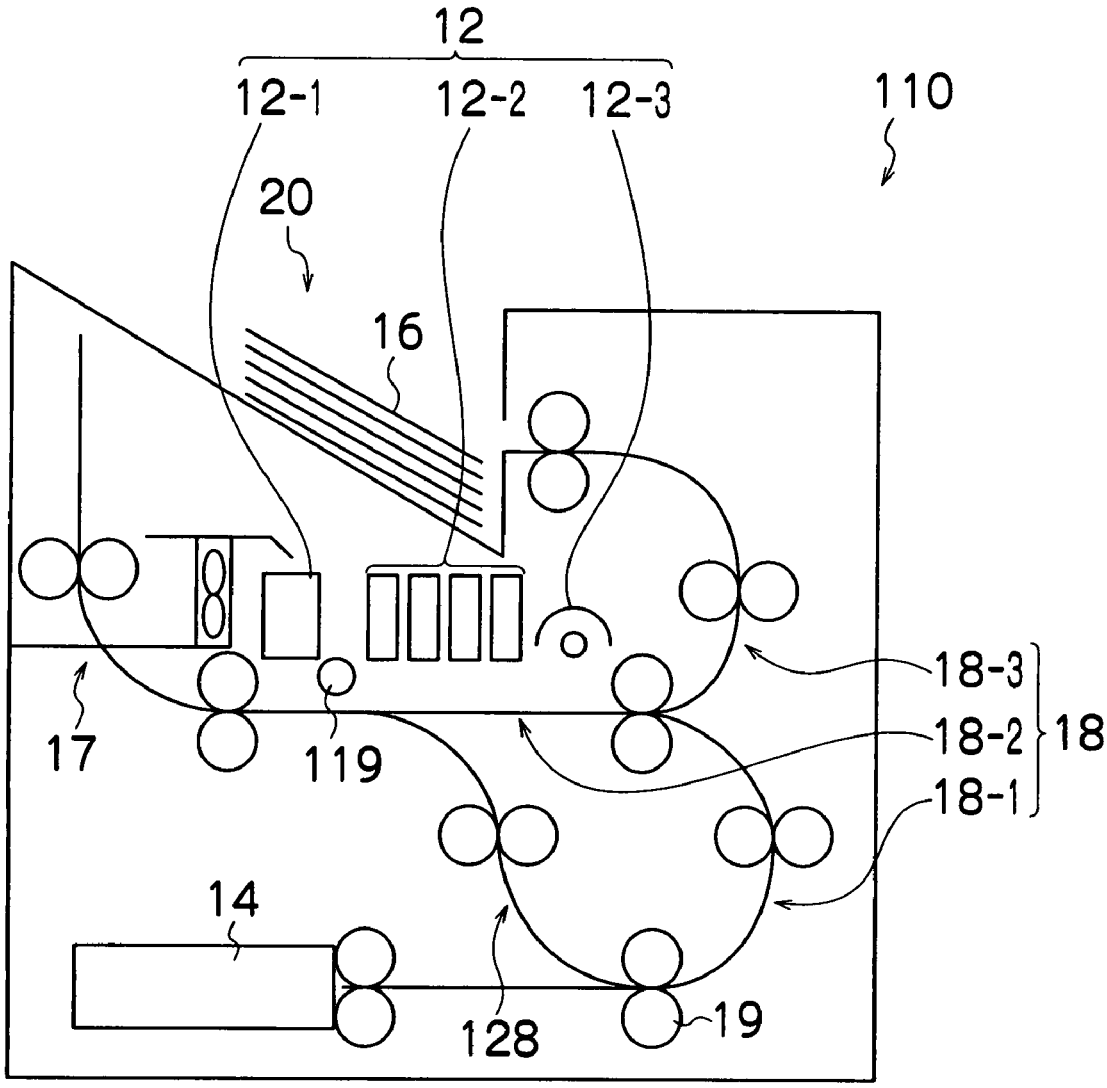
FIG. 17 is a general compositional diagram showing an approximate view of an inkjet recording apparatus forming an image forming apparatus for double-side printing according to a fourth embodiment of the present invention.

FIG. 17 is a diagram showing a general schematic drawing of an inkjet recording apparatus according to a fourth embodiment of the present invention.

As shown in FIG. 17, the basic composition of an inkjet recording apparatus 110 according to the fourth embodiment is substantially the same as that of the inkjet recording apparatus 100 according to the third embodiment described with reference to FIG. 14. The difference is that an inverting path 128 which leads from the first conveyance path 18-1 and merges with the second conveyance path 18-2, is provided instead of the inverting unit 28 of the inkjet recording apparatus 100 according to the third embodiment. The front surface/rear surface orientation of the recording paper 16 is inverted by means of this inverting path 128.

In other words, as shown in FIG. 17, the inkjet recording apparatus 110 comprises: a print unit 12 including a first liquid head group 12-1, a second liquid head group 12-2 and a UV irradiation unit 12-3; a paper supply unit 14; a conveyance unit 18; and a paper output unit 20.

The conveyance unit 18 includes a first conveyance path (paper supply conveyance path) 18-1, a second conveyance path (printing conveyance path) 18-2, a third conveyance path 18-3, a switch-back unit 17 and the inverting path 128.

The inverting path 128 is provided in order to invert the front/rear surface orientation of the recording paper 16, and it forms a conveyance path which branches from the first conveyance path (paper supply conveyance path) 18-1 and then merges with the second conveyance path (printing conveyance path) 18-2 at a position between the first liquid head group 12-1 and the second liquid head group 12-2.

In this way, the inverting path 128 branches from the first conveyance path (paper supply conveyance path) 18-1 and merges with the second conveyance path (printing conveyance path) 18-2 at a position between the first liquid head group 12-1 and the second liquid head group 12-2. Hence, it is possible to reduce the size of the apparatus dramatically in comparison with, for example, an inverting path in which the recording paper is conveyed temporarily to the exterior of the print unit, is then made to perform a large turn, and is then returned back to the entrance of the print unit. Therefore, the installation surface area of the apparatus can be reduced and the apparatus can be composed in a compact fashion.

In the third embodiment described above, since a large number of switch-backs are implemented, the conveyance of the recording paper is often halted temporarily, and therefore recording takes time. The apparatus becomes large in size if it is sought to reduce the number of switch-backs in order to increase the speed of recording, by adopting a composition in which the recording paper is conveyed temporarily to the exterior of the print unit, is then made to perform a large turn, and is then returned back to the entrance of the print unit.

The fourth embodiment has been conceived in order to achieve both the space-saving of the apparatus and increased recording speed at the same time.

Printing onto one surface of the recording paper 16 is performed similarly to the third embodiment. The recording paper 16 supplied from the paper supply unit 14 is conveyed to the second conveyance path 18-2 via the first conveyance path 18-1, and when it passes through the second conveyance path 18-2 for the first time, the paper is conveyed from right to left. On this occasion, liquid ejection is performed only from the first liquid head group 12-1. The conveyance direction is reversed in the switch-back unit 17, and the paper is conveyed again through the second conveyance path 18-2, this time from left to right. On this occasion, colored inks are ejected from the second liquid head group 12-2, and ultraviolet light is radiated from the UV irradiation unit 12-3.

The recording paper 16 which has been printed on one surface thereof is conveyed to the first conveyance path 18-1 and returned toward the paper supply unit 14. In this action, the recording paper 16 is conveyed via the inverting path 128 to the second conveyance path 18-2, and conveyed again into the second conveyance path 18-2. In order that the recording paper 16 is conveyed smoothly from the inverting path 128 to the second conveyance path 18-2, it is desirable to provide an auxiliary roller 119, such as a star wheel.

Next, the double-side printing method of the present embodiment is described below.

FIGS. 18A to 19E are diagrams showing the sequence of a double-side printing method according to the present embodiment.

Figure 18A:
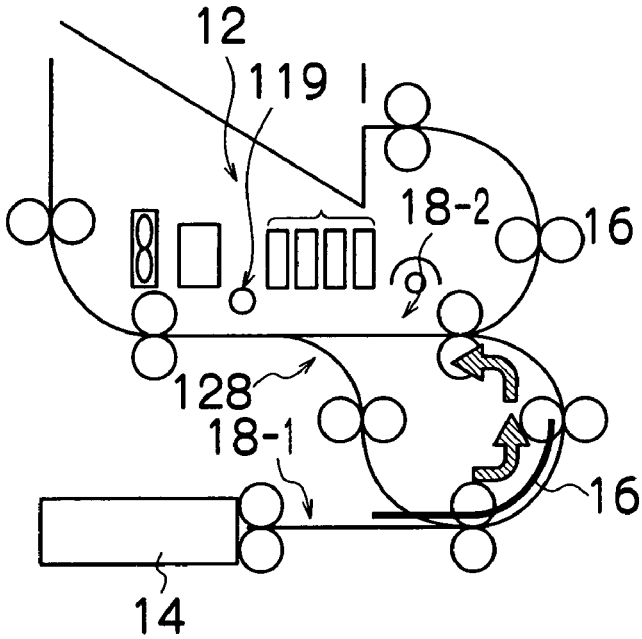
FIGS. 18A to 18E are process step diagrams showing a double-side printing method according to the fourth embodiment.

Firstly, as shown in FIG. 18A, the recording paper 16 supplied from the paper supply unit 14 is conveyed via the first conveyance path 18-1 toward the print unit 12, as indicated by the arrows in FIG. 18A.

Figure 18B:
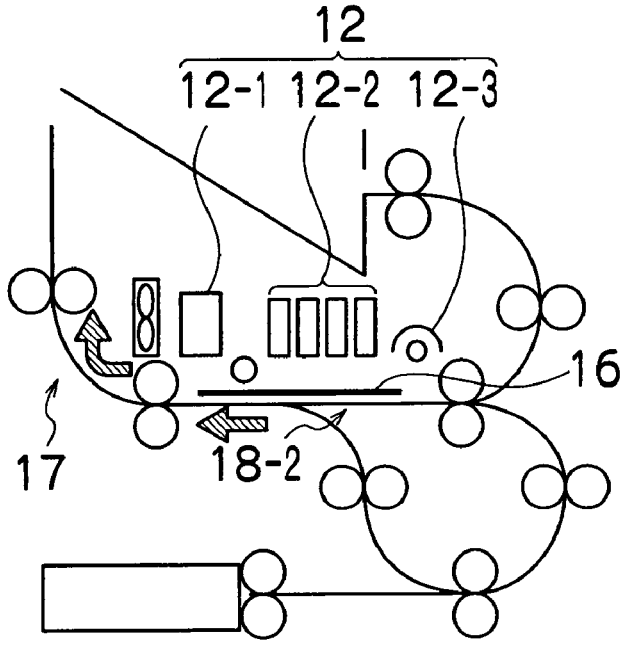

Thereupon, as shown in FIG. 18B, the recording paper 16 is conveyed from right to left following the second conveyance path 18-2, as indicated by the arrow in FIG. 18B. In this case, liquid ejection is not performed by the second liquid head group 12-2, and liquid ejection is performed only by the first liquid head group 12-1. The paper is then conveyed to the switch-back unit 17.

Figure 18C:
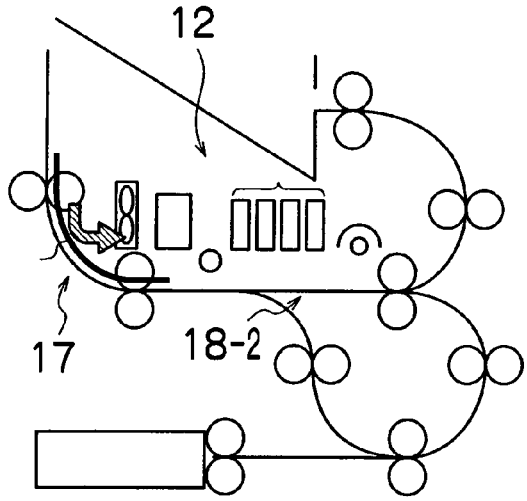

Thereupon, as shown in FIG. 18C, in the switch-back unit 17, the conveyance direction of the recording paper 16 on which the first liquid has been deposited (onto one surface), is reversed as indicated by the arrow in FIG. 18C, and the paper is then conveyed again to the second conveyance path 18-2.

Figure 18D:
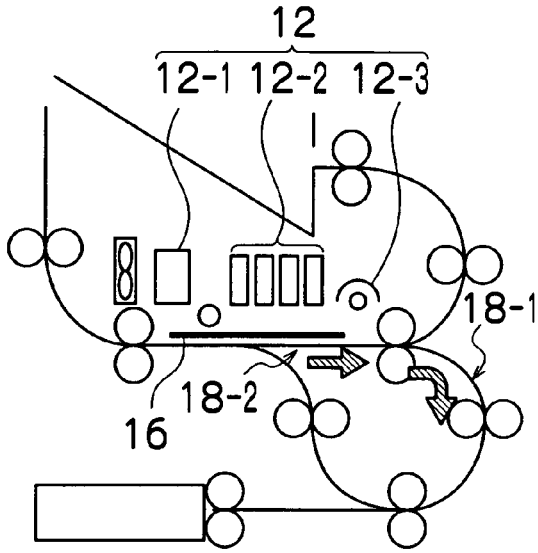

Thereupon, as shown in FIG. 18D, the recording paper 16 is conveyed again through the second conveyance path 18-2, this time, from left to right. In this case, liquid ejection is not performed by the first liquid head group 12-1, and colored inks containing polymerizable compounds are ejected from the second liquid head group 12-2 and deposited onto the recording paper 16. Ultraviolet light is then radiated from the UV irradiation unit 12-3.

In this way, an image is recorded onto one surface of the recording paper 16. Similarly to the third embodiment described above, when printing is performed from either the first liquid head group 12-1 or the second liquid head group 12-2, the mist generated is made to flow in the conveyance direction of the recording paper 16, by the airflow created by the conveyance of the recording paper 16. Consequently, the mist does not reach the other head and contamination is prevented.

Figure 18E:
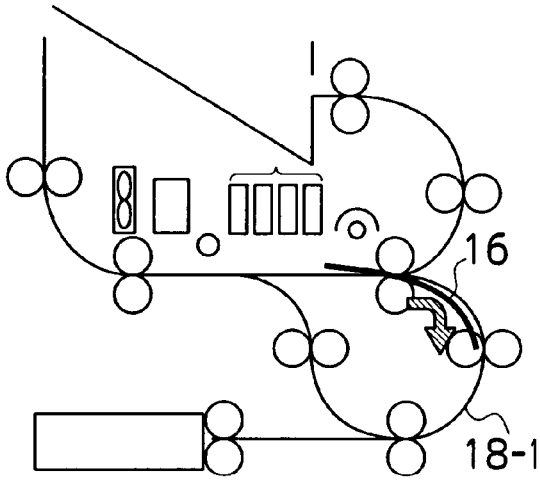

Thereupon, as shown in FIG. 18E, the recording paper 16 on which single-side printing has been completed is conveyed toward the first conveyance path 18-1.

Figure 19A:
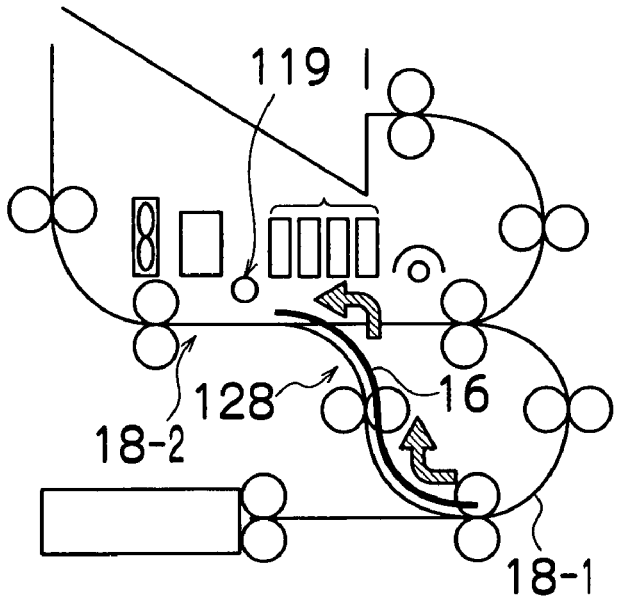
FIGS. 19A to 19E are also process step diagrams showing a double-side printing method according to the fourth embodiment.

Next, as shown in FIG. 19A, the recording paper 16 on which single-side (front surface) printing has been completed and which has been conveyed to the first conveyance path 18-1, is conveyed to an intermediate point of the second conveyance path 18-2, via the inverting path 128. When entering the inverting path 128 from the first conveyance path 18-1, the paper is conveyed in a state where the front surface/rear surface orientation of the recording paper 16 is inverted, in such a manner that the opposite side (rear surface), which has not yet been printed, faces the print unit 12 (in such a manner the rear surface of the recording paper 16 faces upward). When the recording paper 16 is conveyed from the inverting path 128 to the second conveyance path 18-2, the conveyance action with respect to the second conveyance path 18-2 is carried out smoothly by using the auxiliary rollers 119.

Figure 19B:
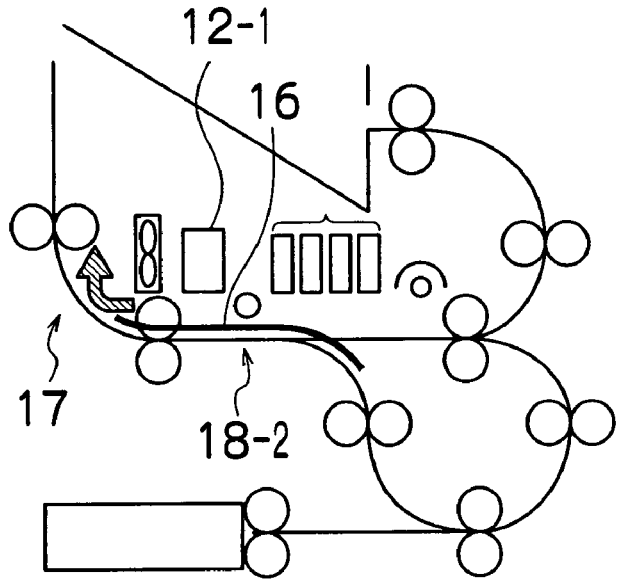

Thereupon, as shown in FIG. 19B, the first liquid is ejected from the first liquid head group 12-1 onto the recording paper 16 which has been conveyed again to the second conveyance path 18-2 from an intermediate point of the second conveyance path 18-2. The recording paper 16 is then conveyed directly to the switch-back unit 17.

Figure 19C:
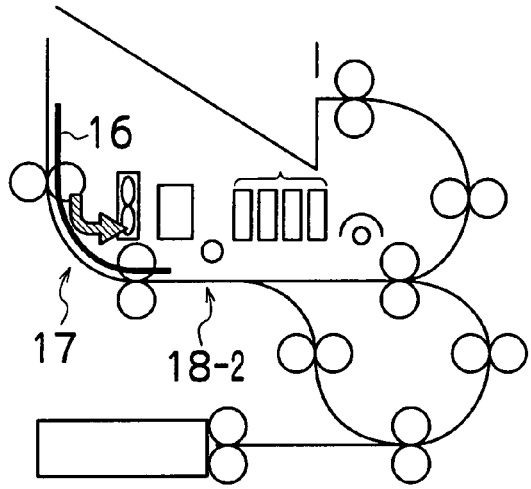

As shown in FIG. 19C, in the switch-back unit 17, the conveyance direction of the recording paper 16 is reversed and the recording paper is conveyed again to the second conveyance path 18-2.

Figure 19D:
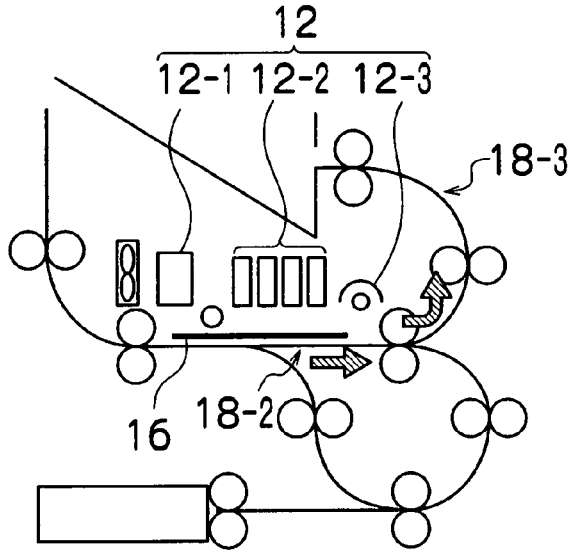

As shown in FIG. 19D, the recording paper 16 is conveyed from left to right through the second conveyance path 18-2. On this occasion, the colored inks are ejected toward the second surface (rear surface) from the second liquid head group 12-2. Thereupon, ultraviolet light is radiated by the UV irradiation unit, thereby curing the liquid on the recording paper 16, and thus completing the double-side printing onto the recording paper 16.

Similarly to the case of the third embodiment described above, when the colored inks are ejected toward the second surface, it is necessary to convert the image data by image processing in such a manner that the image is printed in the opposite direction in terms of its conveyed direction in comparison with printing on the first surface.

Figure 19E:
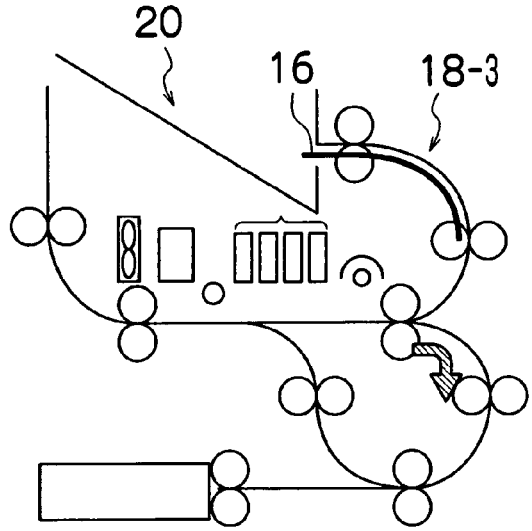

As shown in FIG. 19E, the recording paper 16 which has completed double-side printing is output to the paper output unit 20 via the third conveyance path 18-3.

In this way, in the present embodiment, it is possible to carry out double-side printing while preventing contamination.

Next, a fifth embodiment of the present invention is described below.

Figure 20:
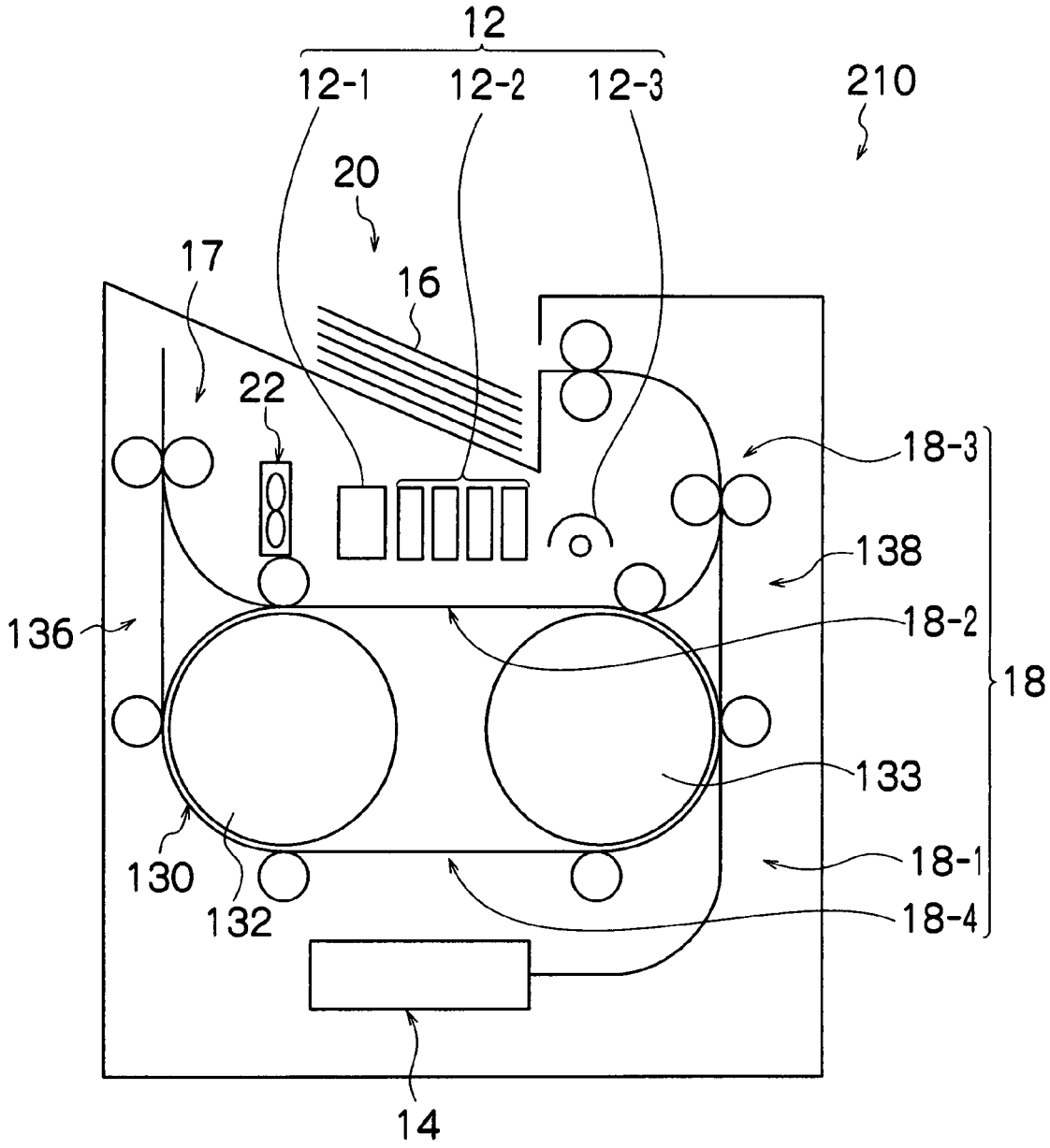
FIG. 20 is a general compositional diagram showing an approximate view of a double-side printing method and an inkjet recording apparatus forming an image forming apparatus for double-side printing according to a fifth embodiment of the present invention.

FIG. 20 is a diagram showing a general schematic drawing of an inkjet recording apparatus according to a fifth embodiment of the present invention.

As shown in FIG. 20, an inkjet recording apparatus 210 according to the fifth embodiment can perform continuous double-side printing of two sheets of recording paper by using an endless belt in the second conveyance path.

Similarly to all embodiments described above, the inkjet recording apparatus 210 principally comprises a paper supply unit 14, a conveyance unit 18 and a paper output unit 20. The conveyance unit 18 includes: a first conveyance path 18-1 for conveying the recording paper 16 from the paper supply unit 14 to the print unit 12; a second conveyance path (printing conveyance path) 18-2 which conveys the recording paper 16 directly below the print unit 12; a third conveyance path 18-3 for conveying the recorded recording paper 16 to a paper output unit 20; and a fourth conveyance path (double-side conveyance path) 18-4. The fourth conveyance path conveys a further sheet of recording paper 16 in conjunction with the conveyance of a first sheet of recording paper 16 while the first sheet of recording paper 16 is being conveyed in the second conveyance path 18-2. The second conveyance path (print conveyance path) 18-2 and the fourth conveyance path (double-side conveyance path) 18-4 are constituted by an endless belt 130 which is wound about two rotating drums 132 and 133. Moreover, the conveyance unit 18 includes a first inverting unit 136 and a second inverting unit 138 for respectively inverting the front surface/rear surface orientation of the two sheets of recording paper 16.

Furthermore, similarly to all embodiments described above, the inkjet recording apparatus 210 also includes a fan 22 and a switch-back unit 17.

Next, a method of performing double-side printing continuously on two sheets of recording paper while preventing contamination according to the present embodiment is described below.

Figure 21A:
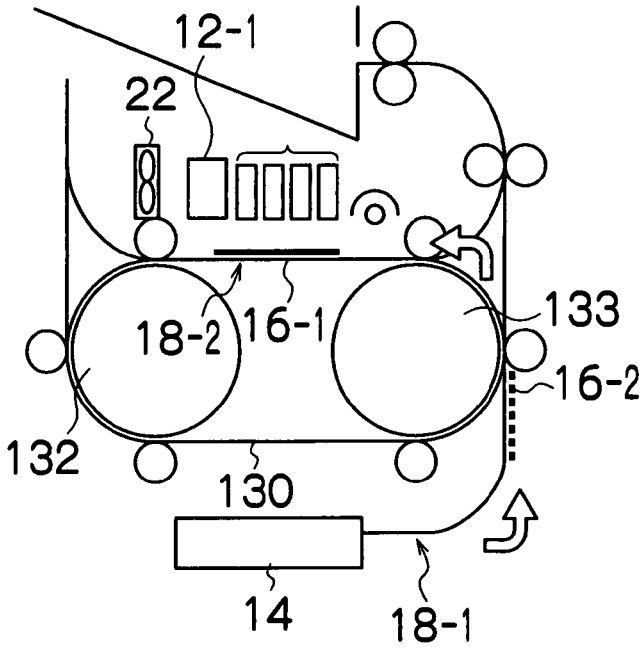
FIGS. 21A to 21E are process step diagrams showing a double-side printing method according to the fifth embodiment.

As shown in FIG. 21A, two sheets of recording paper 16-1 and 16-2 are extracted in a continuous fashion from the paper supply unit 14, and are conveyed from the first conveyance path 18-1 to the second conveyance path 18-2 which is constituted by the endless belt 130. Firstly, a first liquid is ejected from the first liquid head group 12-1 toward the first surface (front surface) of the first recording paper 16-1. In this case, the mist generated from the first liquid head group 12-1 is caused to flow in the conveyance direction of the recording paper 16-1, due to airflow created by the conveyance of the recording paper 16-1. Similarly to the embodiments described above, by switching on the fan 22 to recover the generated mist, the mist removal effect is improved.

Figure 21B:
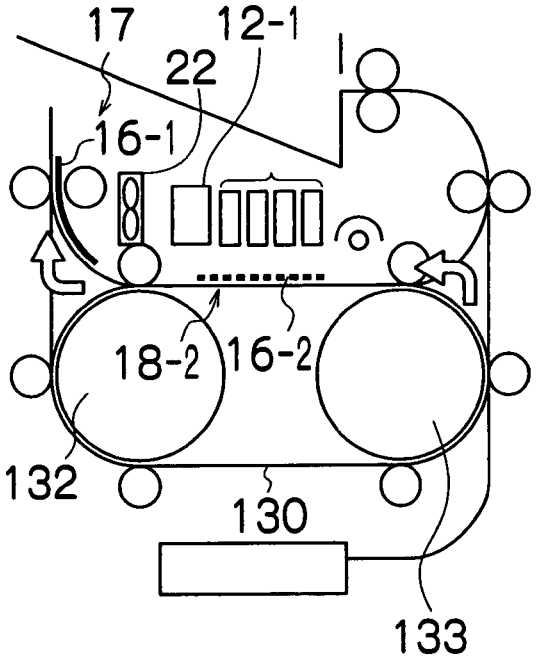

Thereupon, as shown in FIG. 21B, the first sheet of recording paper 16-1 whose first surface (front surface) has been subjected to the liquid ejection of the first liquid, is conveyed to the switch-back unit 17, and at the same time, the first liquid is ejected from the first liquid head group 12-1 toward the first surface (front surface) of the second sheet of recording paper 16-2, similarly to the first sheet.

Figure 21C:
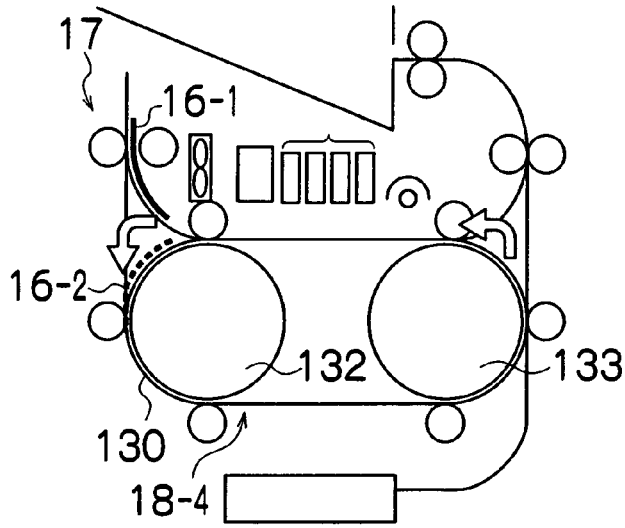

Next, as shown in FIG. 21C, the first recording paper 16-1 is held in the switch-back unit 17. In this case, the second recording paper 16-2 is held on the endless belt 130 and is conveyed to the fourth conveyance path 18-4.

Figure 21D:
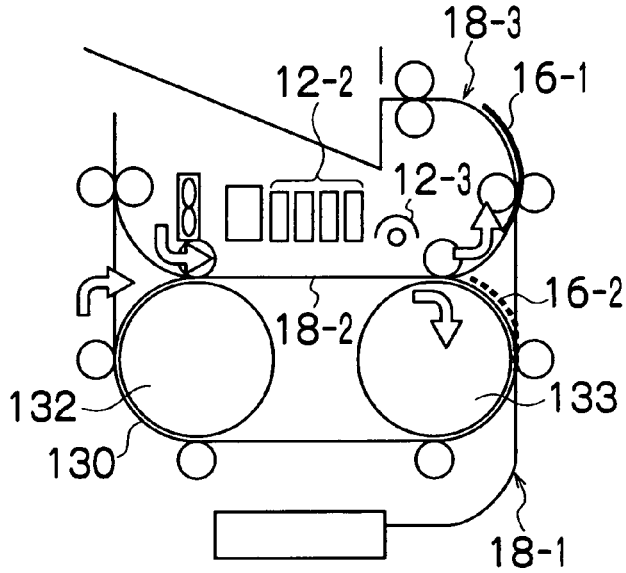

Subsequently, as shown in FIG. 21D, the rotation direction of the rotating drums 132 and 133 is reversed, thereby reversing the direction of movement of the endless belt 130, and firstly, the first sheet of recording paper 16-1 is conveyed from the switch-back unit 17 to the second conveyance path 18-2 and is then conveyed along the second conveyance path 18-2 from left to right. In this case, the colored inks are ejected toward and deposited onto the front surface of the first recording paper 16-1 by the second liquid head group 12-2, whereupon ultraviolet light is radiated by the UV irradiation unit 12-3, and the recording paper 16-1 is then conveyed to and held in the third conveyance path 18-3.

Immediately after the first recording paper 16-1 is conveyed from the switch-back unit 17 to the second conveyance path 18-2, the second recording paper 16-2 is conveyed from left to right through the second conveyance path 18-2, along the endless belt 130. The colored inks are ejected toward and deposited onto the front surface of the second recording paper 16-2 while the second recording paper 16-2 is conveyed along the second conveyance path 18-2, and ultraviolet light is then radiated by the UV irradiation unit 12-3. Thereupon, the paper 16-2, which is still held on the endless belt 130, is then conveyed toward the first conveyance path 18-1 in accordance with the movement of the endless belt 130.

Figure 21E:
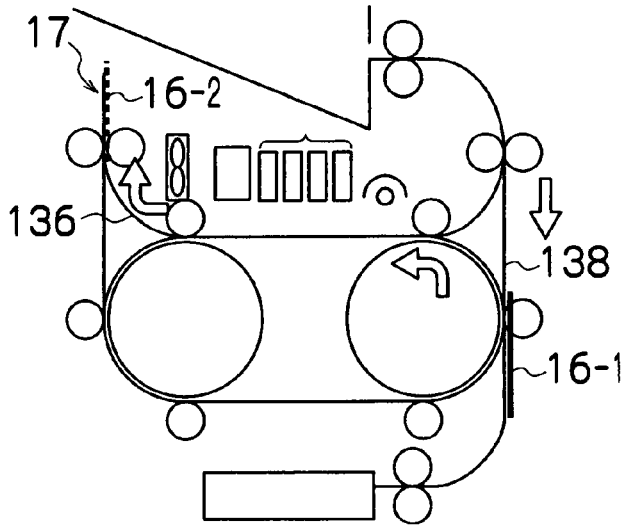

Next, as shown in FIG. 21E, the direction of rotation of the rotating drums 132 and 133 is reversed again, in such a manner that the direction of movement of the endless belt 130 is reversed. The second recording paper 16-2 is then conveyed to the switch-back unit 17 along the endless belt 130, via the second conveyance path 18-2.

Subsequently, the first recording paper 16-1 which has been held in the third conveyance path 18-3 is conveyed toward the first conveyance path 18-1 via the conveyance guides of the second inverting unit 138.

Figure 22A:
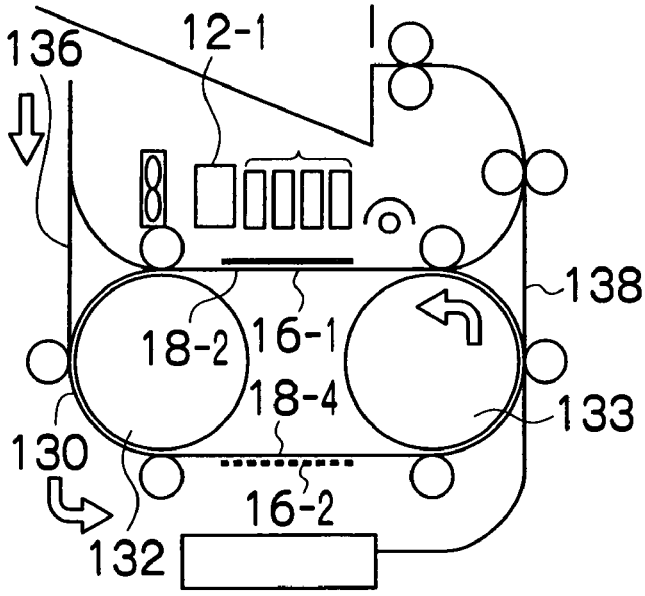
FIGS. 22A to 22E are process step diagrams showing a double-side printing method according to the fifth embodiment.

Thereupon, as shown in FIG. 22A, the second recording paper 16-2 is conveyed via the first inverting unit 136, on the endless belt 130, to the fourth conveyance path 18-4, while the first recording paper 16-1, which has been located in the first conveyance path 18-1, is mounted onto the endless belt 130. The first recording paper 16-1 and the second recording paper 16-2 are respectively conveyed to the second conveyance path 18-2 and the fourth conveyance path 18-4, on the endless belt 130 in conjunction with each other. Thereby, the front surface/rear surface orientations of both the first recording paper 16-1 and the second recording paper 16-2 are inverted, and the rear surfaces which have not yet been printed are made to face the print unit 12. In this case, the first liquid is ejected from the first liquid head group 12-1 toward the rear surface of the first recording paper 16-1 which is conveyed through the second conveyance path 18-2.

Figure 22B:
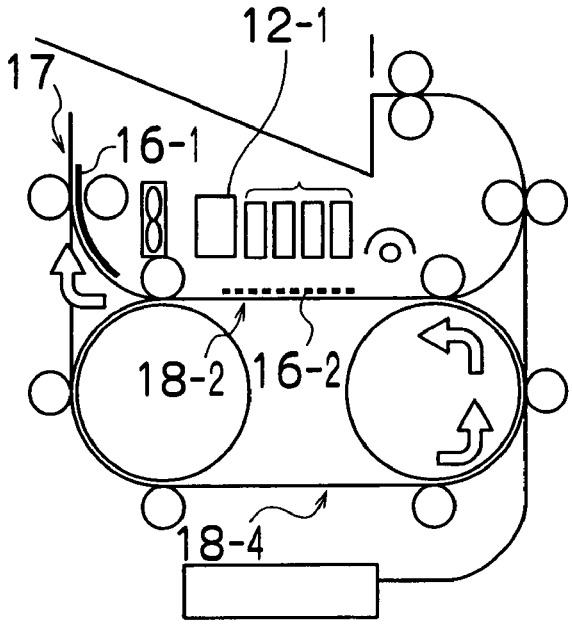

Thereupon, as shown in FIG. 22B, the first recording paper 16-1, whose rear surface has been subjected to the liquid ejection of the first liquid, is conveyed to the switch-back unit 17 and held there. Subsequently, similarly to the first sheet, the first liquid is then ejected from the first liquid head group 12-1 toward the rear surface of the second recording paper 16-2 which has been conveyed on the endless belt 130 through the second conveyance path 18-2.

The mist generated when the first liquid is ejected from the first liquid head group 12-1 is made to flow in the opposite direction from the direction toward the second liquid head group 12-2, because of the airflow created by the conveyance of the recording papers 16-1 and 16-2. Preferably, the fan 22 is switched on, in order to recover the mist and to improve effect of mist removal.

Figure 22C:
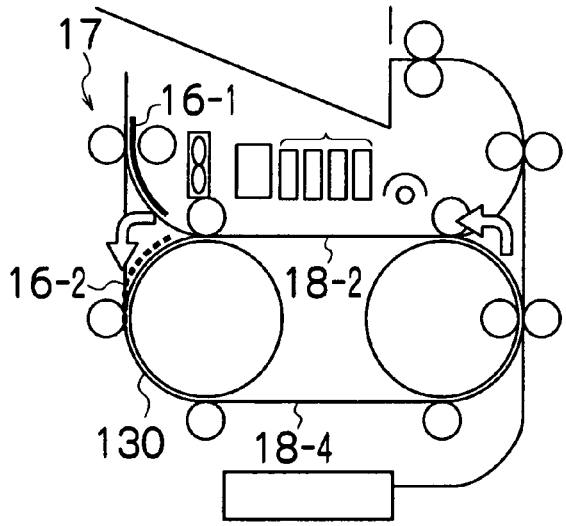

Next, as shown in FIG. 22C, while the first recording paper 16-1 remains held in the switch-back unit 17, the second recording paper 16-2 whose rear surface has been subjected to the liquid ejection of the first liquid is held on the endless belt 130. The second recording paper 16-2 is then conveyed toward the fourth conveyance path 18-4.

Figure 22D:
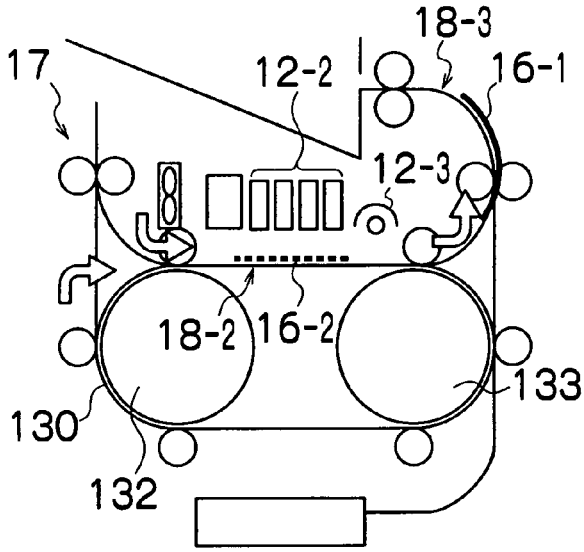

Thereupon, as shown in FIG. 22D, the rotation direction of the rotating drums 132 and 133 is reversed, thereby reversing the rotation direction of the endless belt 130. Firstly, the first recording paper 16-1 held in the switch-back unit 17 is conveyed from left to right through the second conveyance path 18-2, and subsequently, the second recording paper 16-2 which is situated in the fourth conveyance path 18-4, is conveyed to the second conveyance path 18-2.

The colored inks are ejected from the second liquid head group 12-2 toward the rear surface of the first recording paper 16-1 while the first recording paper 16-1 is conveyed through the second conveyance path 18-2. Ultraviolet light is then radiated onto the rear surface of the first recording paper 16-1 by the UV irradiation unit 12-3. The first recording paper 16-1 is then conveyed to the third conveyance path 18-3. Thereupon, the colored inks are ejected from the second liquid head group 12-2 toward the rear surface of the second recording paper 16-2, while the second recording paper 16-2 is conveyed through the second conveyance path 18-2.

When recording an image onto the rear surface of each recording paper, as described above, the image data needs to be converted in such a manner that the image is recorded in the opposite direction in terms of its conveyance orientation in comparison with printing on the front surface.

Figure 22E:
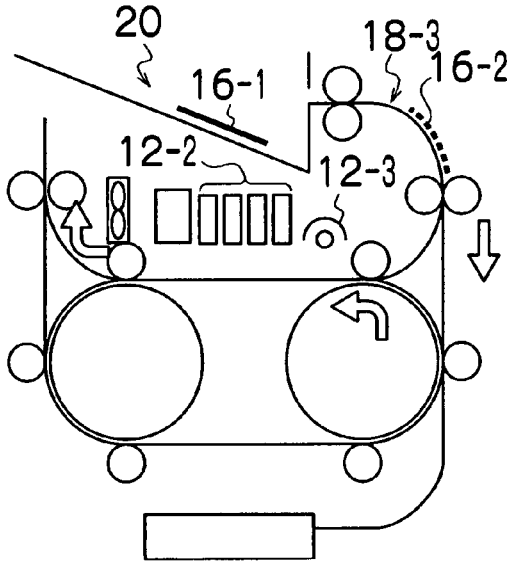

Thereupon, as shown in FIG. 22E, the first recording paper 16-1 which has completed image recording on both surfaces is output from the third conveyance path 18-3 to the paper output unit 20. Furthermore, when the second recording paper 16-2 has completed printing of the second liquid onto the rear surface thereof, it is irradiated with ultraviolet light by the UV irradiation unit 12-3, conveyed to the third conveyance path 18-3, and then output to the paper output unit 20.

In this way, in the present embodiment, it is possible to carry out double-side printing on two sheets of recording paper, in a continuous fashion, while preventing the occurrence of contamination.

As described above, according to the fifth embodiment, the second conveyance path (printing conveyance path) and the fourth conveyance path (double-side conveyance path) have the same conveyance direction and two sheets of paper are conveyed simultaneously in conjunction with each other by means of an endless belt, as shown in, for example, FIG. 22A. It is thereby possible to simplify the conveyance guides and to reduce the conveyance rollers, and costs can therefore be lowered.

Moreover, two sheets of recording paper are printed in a continuous fashion as described above, and hence the recording media passes the print unit continuously. Ejection is thus performed in a substantially continuous fashion, and therefore, the waiting time between recording media is small, increase in the ink viscosity in the vicinity of the nozzles can be prevented, and the frequency of purging can be reduced.

A liquid droplet ejection method, a liquid droplet ejection apparatus, a double-side printing method, and an image recording apparatus for double-side printing according to embodiments of the present invention are described in detail above, but the present invention is not limited to the aforementioned embodiments, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a print unit including a first ejection head which ejects a first liquid and a second ejection head which ejects a second liquid, the second ejection head being disposed on an upstream side of the first ejection head in terms of a first conveyance direction;

a conveyance device which conveys a recording medium relatively with respect to the print unit; and a switch-back unit which reverses a relative conveyance direction of the recording medium, from the first conveyance direction in which the recording medium is relatively conveyed for a first time, to a second conveyance direction which is opposite to the first conveyance direction and in which the recording medium is relatively conveyed for a second time, wherein:

the first ejection head ejects the first liquid toward the recording medium and the second ejection head does not eject the second liquid when the recording medium is relatively conveyed in the first conveyance direction for the first time;

the switch-back unit reverses the relative conveyance direction of the recording medium from the first conveyance direction to the second conveyance direction; and the first ejection head does not eject the first liquid and the second ejection head ejects the second liquid toward the recording medium when the recording medium is relatively conveyed in the second conveyance direction for the second time.

2. The liquid ejection apparatus as defined in claim 1, further comprising:

a radiation irradiating unit which is disposed on a downstream side of the second ejection head in terms of the second conveyance direction and irradiates the recording medium on which the first liquid and the second liquid have been deposited, wherein the first liquid is a treatment liquid containing a radiation curing initiator, and the second liquid is an ink containing a polymerizable compound.

3. The liquid ejection apparatus as defined in claim 2, further comprising:

a squeezing unit which is disposed on an immediately downstream side of the first ejection head in terms of the first conveyance direction and which squeezes the excess first liquid deposited on the recording medium.

4. The liquid ejection apparatus as defined in claim 1, wherein the first liquid is a treatment liquid containing an aggregating agent, and the second liquid is an ink containing an aggregation material which aggregates by reacting with the aggregating agent.

5. The liquid ejection apparatus as defined in claim 4, further comprising:

a squeezing unit which is disposed on an immediately downstream side of the first ejection head in terms of the first conveyance direction and which squeezes the excess first liquid deposited on the recording medium.

6. An image forming apparatus, comprising:

the liquid ejection apparatus as defined in claim 1.

7. The liquid ejection apparatus as defined in claim 1, further comprising:

a fan which inhales mist of the first liquid occurring when the first ejection head ejects the first liquid toward the recording medium, the fan being disposed on a downstream side of the first ejection head in terms of the first conveyance direction; and an air duct which directs airflow from the first ejection head toward the fan.

8. A liquid ejection method for a liquid ejection apparatus which has a print unit including a first ejection head for ejecting a first liquid and a second ejection head for ejecting a second liquid and which conveys a recording medium relatively with respect to the print unit, the liquid ejection method comprising:

performing a first relative conveyance to convey the recording medium relatively with respect to the print unit;

reversing a relative conveyance direction of the recording medium with respect to the print unit after the first relative conveyance; and performing a second relative conveyance to convey the recording medium relatively with respect to the print unit again, wherein:

in the first relative conveyance, the second ejection head does not eject the second liquid when the recording medium passes below the second ejection head, and the first ejection head ejects the first liquid toward the recording medium when the recording medium passes below the first ejection head;

in the second relative conveyance, the first ejection head does not eject the first liquid when the recording medium passes below the first ejection head, and the second ejection head ejects the second liquid toward the recording medium when the recording medium passes below the second ejection head.

9. The liquid ejection method as defined in claim 8, further comprising:

irradiating the recording medium on which the first liquid and the second liquid have been deposited, wherein the first liquid is a treatment liquid containing a radiation curing initiator, and the second liquid is an ink containing a polymerizable compound.

10. An image recording apparatus for double-side printing, comprising:

a print unit including a first ejection head which ejects a first liquid and a second ejection head which ejects a second liquid, the second ejection head being disposed on an upstream side of the first ejection head in terms of a first conveyance direction;

a paper supply unit for supplying a recording medium;

a conveyance device for relatively conveying the recording medium supplied from the paper supply unit, with respect to the print unit;

a switch-back unit which reverses a relative conveyance direction of the recording medium, from the first conveyance direction in which the recording medium is relatively conveyed for a first time, to a second conveyance direction which is opposite to the first conveyance direction and in which the recording medium is relatively conveyed for a second time; and an inverting unit which inverts the recording medium, wherein:

the first ejection head ejects the first liquid toward a front surface of the recording medium and the second ejection head does not eject the second liquid when the recording medium is relatively conveyed in the first conveyance direction for the first time, and the first ejection head does not eject the first liquid and the second ejection head ejects the second liquid toward the front surface of the recording medium when the recording medium is relatively conveyed in the second conveyance direction for the second time after the switch-back unit reverses the relative conveyance direction of the recording medium from the first conveyance direction to the second conveyance direction, in such a manner that printing is performed on the front surface of the recording medium;

the inverting unit inverts the recording medium after printing is performed on the front surface of the recording medium;

after the inverting unit inverts the recording medium, the first ejection head ejects the first liquid toward a rear surface of the recording medium and the second ejection head does not eject the second liquid when the recording medium is relatively conveyed in the first conveyance direction, and the first ejection head does not eject the first liquid and the second ejection head ejects the second liquid toward the rear surface of the recording medium when the recording medium is relatively conveyed in the second conveyance direction after the switch-back unit reverses the relative conveyance direction of the recording medium from the first conveyance direction to the second conveyance direction, in such a manner that printing is performed on the rear surface of the recording medium.

11. The image recording apparatus for double-side printing as defined in claim 10, wherein:

the conveyance device includes a paper supply conveyance path through which the recording medium supplied from the paper supply unit is conveyed to the print unit, and a printing conveyance path through which the recording medium is conveyed relatively in the print unit; and the inverting unit includes an inverting path which branches from the paper supply conveyance path at an intermediate point of the paper supply conveyance path and merges with the printing conveyance path at a point between the first ejection head and the second ejection head.

12. The image recording apparatus for double-side printing as defined in claim 10, wherein the printing conveyance path is constituted by an endless belt.

13. The image recording apparatus for double-side printing as defined in claim 10, further comprising:

a radiation irradiating unit which is disposed on a downstream side of the second ejection head in terms of the second conveyance direction and irradiates the recording medium on which the first liquid and the second liquid have been deposited, wherein the first liquid is a treatment liquid containing a radiation curing initiator, and the second liquid is an ink containing a polymerizable compound.

14. The image recording apparatus for double-side printing as defined in claim 10, further comprising:

a fan which inhales mist of the first liquid occurring when the first ejection head ejects the first liquid toward the recording medium, the fan being disposed on a downstream side of the first ejection head in terms of the first conveyance direction; and an air duct which directs airflow from the first ejection head toward the fan.

15. A double-side printing method for a liquid ejection apparatus which has a print unit including a first ejection head for ejecting a first liquid and a second ejection head for ejecting a second liquid and which conveys a recording medium relatively with respect to the print unit, the double-side printing method comprising:

performing a first relative conveyance to convey the recording medium relatively with respect to the print unit;

reversing a relative conveyance direction of the recording medium with respect to the print unit after the first relative conveyance;

performing a second relative conveyance to convey the recording medium relatively with respect to the print unit after reversing the relative conveyance direction of the recording medium after the first relative conveyance;

inverting the recording medium after the second relative conveyance;

performing a third relative conveyance to convey the recording medium relatively with respect to the print unit after inverting the recording medium;

reversing the relative conveyance direction of the recording medium with respect to the print unit after the third relative conveyance; and performing a fourth relative conveyance to convey the recording medium relatively with respect to the print unit after reversing the relative conveyance direction of the recording medium after the third relative conveyance, wherein:

in the first relative conveyance, the second ejection head does not eject the second liquid when the recording medium passes below the second ejection head, and the first ejection head ejects the first liquid toward the front surface of the recording medium when the recording medium passes below the first ejection head after the recording medium passes below the second ejection head;

in the second relative conveyance, the first ejection head does not eject the first liquid when the recording medium passes below the first ejection head, and the second ejection head ejects the second liquid toward the front surface of the recording medium when the recording medium passes below the second ejection head after the recording medium passes below the first ejection head;

in the third relative conveyance, the second ejection head does not eject the second liquid when the recording medium passes below the second ejection head, and the first ejection head ejects the first liquid toward the rear surface of the recording medium when the recording medium passes below the first ejection head after the recording medium passes below the second ejection head; and in the fourth relative conveyance, the first ejection head does not eject the first liquid when the recording medium passes below the first ejection head, and the second ejection head ejects the second liquid toward the rear surface of the recording medium when the recording medium passes below the second ejection head after the recording medium passes below the first ejection head.

16. The double-side printing method as defined in claim 15, further comprising:

irradiating the front surface of the recording medium on which the first liquid and the second liquid have been deposited; and irradiating the rear surface of the recording medium on which the first liquid and the second liquid have been deposited, wherein the first liquid is a treatment liquid containing a radiation curing initiator, and the second liquid is an ink containing a polymerizable compound.

* * * * *